US009854379B2

(12) United States Patent
Park

(10) Patent No.: US 9,854,379 B2
(45) Date of Patent: Dec. 26, 2017

(54) PERSONAL AUDIO STUDIO SYSTEM

(71) Applicant: Center for Integrated Smart Sensors Foundation, Daejeon (KR)

(72) Inventor: Ji Hoon Park, Daejeon (KR)

(73) Assignee: Center for Integrated Smart Sensors Foundation, Daejeon (KR)

( * ) Notice: Subject to any disclaimer, the term of this patent is extended or adjusted under 35 U.S.C. 154(b) by 0 days.

(21) Appl. No.: 15/112,685

(22) PCT Filed: Jan. 23, 2015

(86) PCT No.: PCT/KR2015/000762
§ 371 (c)(1),
(2) Date: Sep. 6, 2016

(87) PCT Pub. No.: WO2015/111969
PCT Pub. Date: Jul. 30, 2015

(65) Prior Publication Data

US 2017/0006402 A1 Jan. 5, 2017

(30) Foreign Application Priority Data

Jan. 23, 2014 (KR) ..... 10-2014-0008594

(51) Int. Cl.
*H04S 7/00* (2006.01)
*G10L 19/20* (2013.01)
*G10L 19/008* (2013.01)

(52) U.S. Cl.
CPC ..... *H04S 7/30* (2013.01); *G10L 19/008* (2013.01); *G10L 19/20* (2013.01); *H04S 2400/03* (2013.01); *H04S 2400/11* (2013.01)

(58) Field of Classification Search
None
See application file for complete search history.

(56) References Cited

U.S. PATENT DOCUMENTS 8,417,531 B2 * 4/2013 Kim ..... G10L 19/008 381/17
2011/0182432 A1 * 7/2011 Ishikawa ..... G10L 19/008 381/22
2012/0057078 A1 * 3/2012 Fincham ..... H04N 5/57 348/645
2012/0078642 A1 * 3/2012 Seo ..... G10L 19/008 704/500
2012/0230497 A1 * 9/2012 Dressler ..... H04S 3/02 381/22

FOREIGN PATENT DOCUMENTS

KR 1020100132913 A 12/2010

OTHER PUBLICATIONS

Park, "A Study on Harmonic Information based Vocal Removal and Enhanced Personal Audio Studio," PhD. Dissertation, Department of Electrical Engineering, Kaist, 2013.
Park et al., "A Study on Vocal Remove Scheme of SAOC Using Harmonic Information," Journal of Korea Multimedia Society. 16(10):1171-9 (2013). English abstract provided.
Park et al., "Vocal Removal From Multiobject Audio Using Harmonic Information for Karaoke Service," IEEE Transactions on Audio, Speech, and Language Processing. 21(4):798-805 (2013).
International Search Report for PCT/KR2015/000762, dated Feb. 23, 2016, 2 pages.

* cited by examiner

*Primary Examiner* — Curtis Kuntz
*Assistant Examiner* — Kenny Truong
(74) *Attorney, Agent, or Firm* — Hoffman Warnick LLC

(57) ABSTRACT

One embodiment of the present invention provides technology which enables a user to process non-compressed input content or compressed input content according to settings of the user, and technology capable of selectively supporting adding, editing, and eliminating an object from the compressed input content on the basis of various coding methods.

15 Claims, 24 Drawing Sheets

PERSONAL AUDIO STUDIO SYSTEM

TECHNICAL FIELD

Embodiments of the inventive concepts described herein relate to personal audio studio systems.

BACKGROUND ART

With the development of Internet services, broadband networks, multimedia devices, and multimedia content, users have wanted to receive more advanced audio services. Further, a trend to develop audio codecs has also been changed.

For example, a high quality audio service has been developed based on a spatial audio object coding (SAOC) technique and an SAOC two-step coding (S-TSC) technique.

In this regard, Korean Patent Laid-open Publication No. 10-2010-143907 discloses a method and apparatus for encoding a multi-object audio signal, a decoding method and apparatus therefor, and a transcoding method and a transcoder therefor.

According to the Korean Patent Laid-open Publication No. 2010-143907, the apparatus for encoding the multi-object audio signal discloses a method for providing satisfactory sound quality to listeners by encoding object signals except for foreground object signals among a plurality of input object signals and encoding foreground object signals.

DISCLOSURE

Technical Problem

Embodiments of the inventive concepts provide a technology for processing one of non-compressed input content and compressed input content based on settings of a user.

Embodiments of the inventive concepts provide a technology for selectively supporting to add, edit, or eliminate an object with respect to a compressed input content based on various coding methods.

Technical Solution

One aspect of embodiments of the inventive concept is directed to provide a personal audio studio system. The personal audio studio system may include a selector configured to select one of non-compressed input content and compressed input content including a plurality of object signals, a first object control module configured to compress the non-compressed input content, and a second object control module configured to remove an object signal from the compressed input content, to edit the object signal for the compressed input content, or to insert the object signal into the compressed input content.

One aspect of embodiments of the inventive concept is directed to provide a control module of a personal audio studio system. The control module may include an object removal module and an object insertion module. The object removal module may remove an object using one of object removal based on an SAOC method, object removal based on a VHC method, and object removal based on an RC method. The object insertion module may insert an object using one of object insertion based on the SAOC method, object insertion based on the VHC method, and object insertion based on the RC method.

Advantaeous Effects

According to various embodiments, a personal audio studio system may provide a technology for processing one of non-compressed input content and compressed input content based on settings of a user.

According to various embodiments, the personal audio studio system may provide a technology for selectively supporting to add, edit, or eliminate an object with respect to compressed input content based on various coding methods.

BEST MODE

Hereinafter, a description will be given in detail of embodiments with reference to the accompanying drawings.

1. Spatial Audio Object Coding

Figure 1:
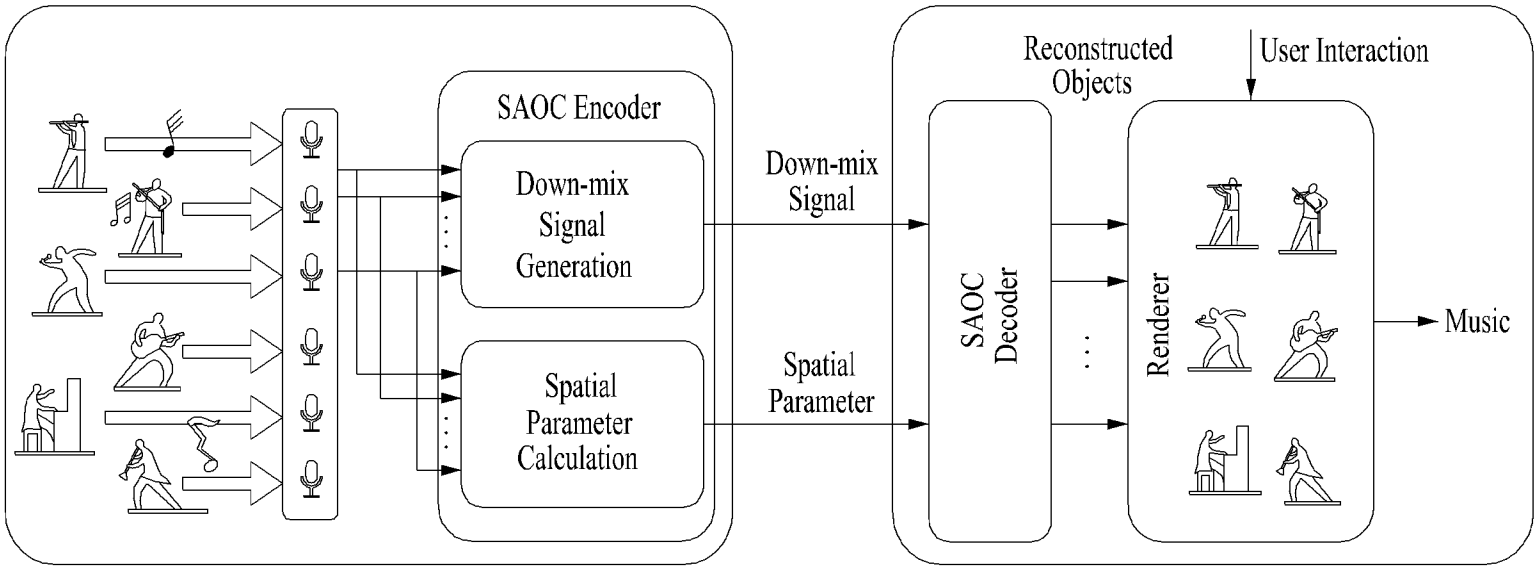
FIG. 1 is a block diagram illustrating a spatial audio object coding (SAOC) encoder and an SAOC decoder.

FIG. 1 is a block diagram illustrating a spatial audio object coding (SAOC) encoder and an SAOC decoder.

Referring to FIG. 1, a producer/service provider-side device and a user-side device according to an SAOC technique are shown. The producer/service provider-side device may include an SAOC encoder, and the user-side device may include an SAOC decoder and a renderer. The SAOC technique may be a multi-object coding technique of representing audio objects as a down-mix signal and a spatial parameter and compressing the down-mix signal and the spatial parameter at a low bit rate.

The SAOC encoder may convert input object signals into a down-mix signal and a spatial parameter and may send the down-mix signal and the spatial parameter to the SAOC decoder. The SAOC decoder may reconstruct an object signal using the received down-mix signal and the received spatial parameter. The renderer may generate final music by rendering each of objects based on user interaction.

The SAOC encoder may calculate the down-mix signal and an object level difference (OLD) which is the spatial parameter. The down-mix signal may be obtained by calculating a weighted sum of input signals. Also, the OLD may be obtained by performing normalization using the highest power in sub-band power each of objects. The OLD may be defined based on Equation 1 below.

$$OLD_i(b) = \frac{P_i(b)}{\max\limits_{1 \le j \le N} p_j(b)}, \quad \begin{matrix} i = 1, \ldots, N \\ b = 1, \ldots, B \end{matrix} \qquad \text{[Equation 1]}$$

Herein, P may represent parameter sub-band power. B may rep resent the number of parameter sub-bands. N may represent the number of input objects.

The SAOC decoder may reconstruct an object signal through the down-mix signal and the OLD. In detail, the SAOC may reconstruct the object signal using Equation 2 below.

$$\hat{X}(k) = D(k)\sqrt{\frac{OLD_i(b)}{\sum\limits_{j=1}^{N} OLD_j(b)}}, \; k \in b \qquad \text{[Equation 2]}$$

In the SAOC technique, when the SAOC decoder wants to adjust a specific object, it may adjust the specific object from the down-mix signal by only using the OLD.

2. Vocal Harmonic Coding

Figure 2:
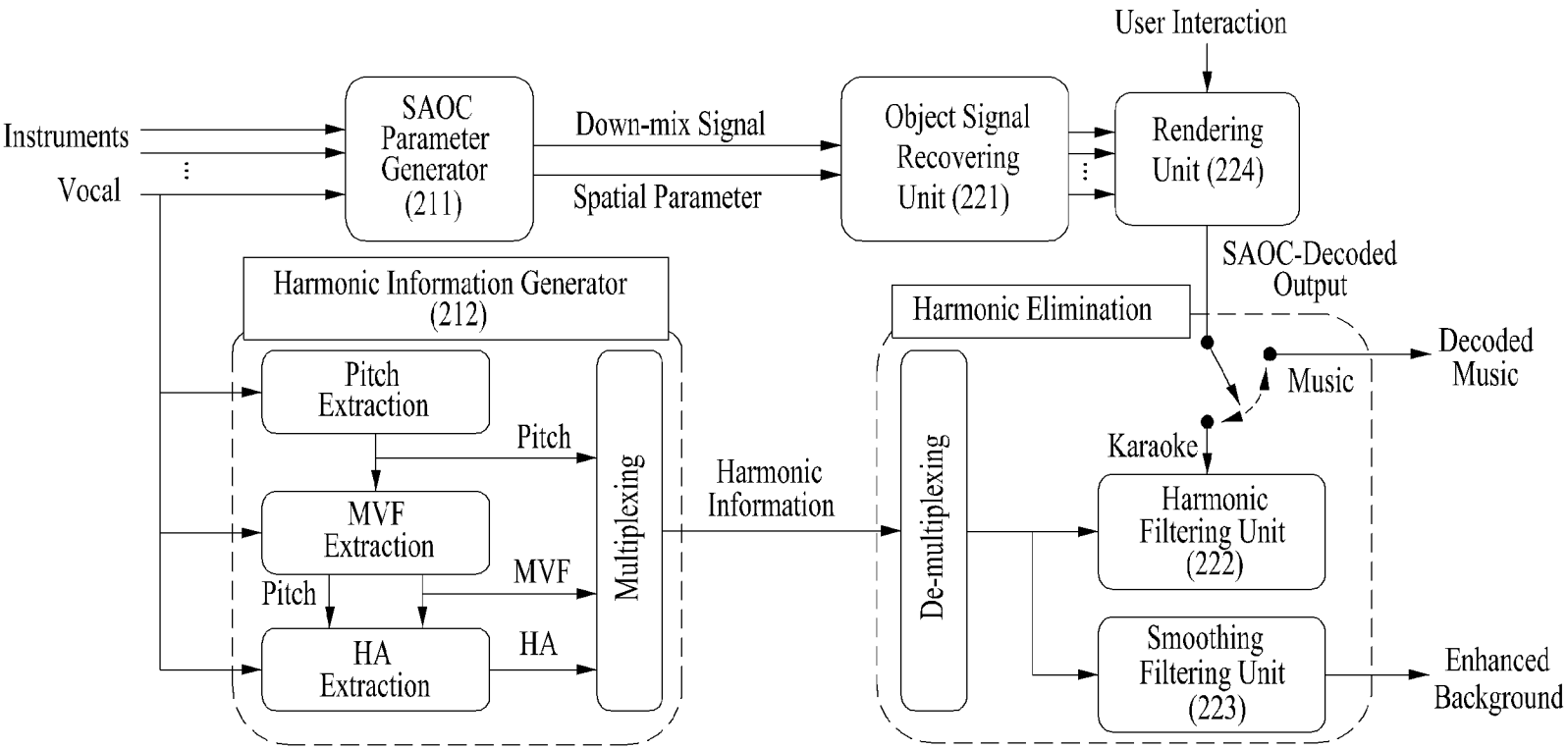
FIG. 2 is a block diagram illustrating an encoding device for vocal harmonic coding (VHC) and a decoding device for VHC.

FIG. 2 is a block diagram illustrating an encoding device for VHC and a decoding device for VHC.

Referring to FIG. 2, an SAOC parameter generator 211, a harmonic information generator 212, an object signal recovering unit 221, a harmonic filtering unit 222, a smoothing filtering unit 223, and a rendering unit 224.

The SAOC parameter generator 211 may generate a down-mix signal by calculating a weighted-sum of a plurality of input object signals including a vocal object signal and an instrument object signal and may generate a spatial parameter by normalizing sub-band power of each of the plurality of input object signals. The SAOC parameter generator 211 may correspond to an SAOC encoder of FIG. 1. The down-mix signal and the spatial parameter may be sent to the harmonic information generator 212.

To eliminate a harmonic component, generated when the instrument object signal is recovered, from the down-mix signal using the spatial parameter, the harmonic information generator 212 may generate harmonic information from the vocal object signal.

If the vocal object signal is eliminated from the down-mix signal based on an OLD, there may be a difference between results of eliminating an unvoiced signal and a voiced signal included in the vocal object signal. If the vocal object signal is eliminated based on the OLD from the down-mix signal to obtain a background signal configured with the instrument object signal, there may actually be a result of reducing performance of removing the voiced signal.

The harmonic information may include a pitch of the voiced signal included in the vocal object signal, a maximum harmonic frequency of the voiced signal, or spectrum harmonic magnitude of the voiced signal. In the specification, the harmonic component may correspond to the voiced signal.

In this case, the harmonic information generator 212 may generate pitch information of the voiced signal included in the vocal object signal, may generate maximum harmonic frequency information of the voiced signal using the pitch information, and may generate spectrum harmonic amplitude of the voiced signal using the pitch information and the maximum harmonic frequency information. The process of generating the pitch information of the voiced signal, the maximum harmonic frequency information of the voiced signal, and the spectrum harmonic amplitude of the voiced signal will be described in detail with reference to FIGS. 4 to 8.

The harmonic information generator 212 may quantize the spectrum harmonic amplitude of the voiced signal included in the vocal object signal using a quantization table calculated based on a mean value of sub-band power of the vocal object signal and sub-band power of the vocal object signal. The process of quantizing the spectrum harmonic amplitude of the voiced signal will be described in detail with reference to FIG. 8.

The object signal recovering unit 221 may recover the vocal object signal and the instrument object signal from the down-mix signal using the spatial parameter. The object signal recovering unit 221 may correspond to an SAOC decoder of FIG. 1.

The harmonic filtering unit 222 may eliminate a harmonic component from the recovered instrument object signal using the recovered vocal object signal and the harmonic information. The harmonic information may be information generated in an encoding device to eliminate a harmonic component generated when the instrument object is recovered from the down-mix signal. A detailed operation of the harmonic filtering unit 222 will be described with reference to FIG. 9.

The smoothing filtering unit 223 may smooth the instrument object signal in which the harmonic component is eliminated. The smoothing of the instrument object signal may be an operation of reducing discontinuity based on the harmonic filtering unit 222. A detailed operation of the smoothing filtering unit 223 will be described with reference to FIG. 9.

The rendering unit 224 may generate an SAOC-decoded output using the recovered vocal object signal and the recovered instrument object signal. The rendering unit 224 may correspond to a renderer of FIG. 1.

If a user input is an input for outputting music, the output signal of the rendering unit 224 may be output through a speaker without change. If a user input is an input for outputting background music in which vocals are eliminated from a song, the output signal of the rendering unit 224 may be sent to the harmonic filtering unit 222. In this case, the output signal of the rendering unit 224 may be output as enhanced background music through the harmonic filtering unit 222 and the smoothing filtering unit 223.

Figure 3:
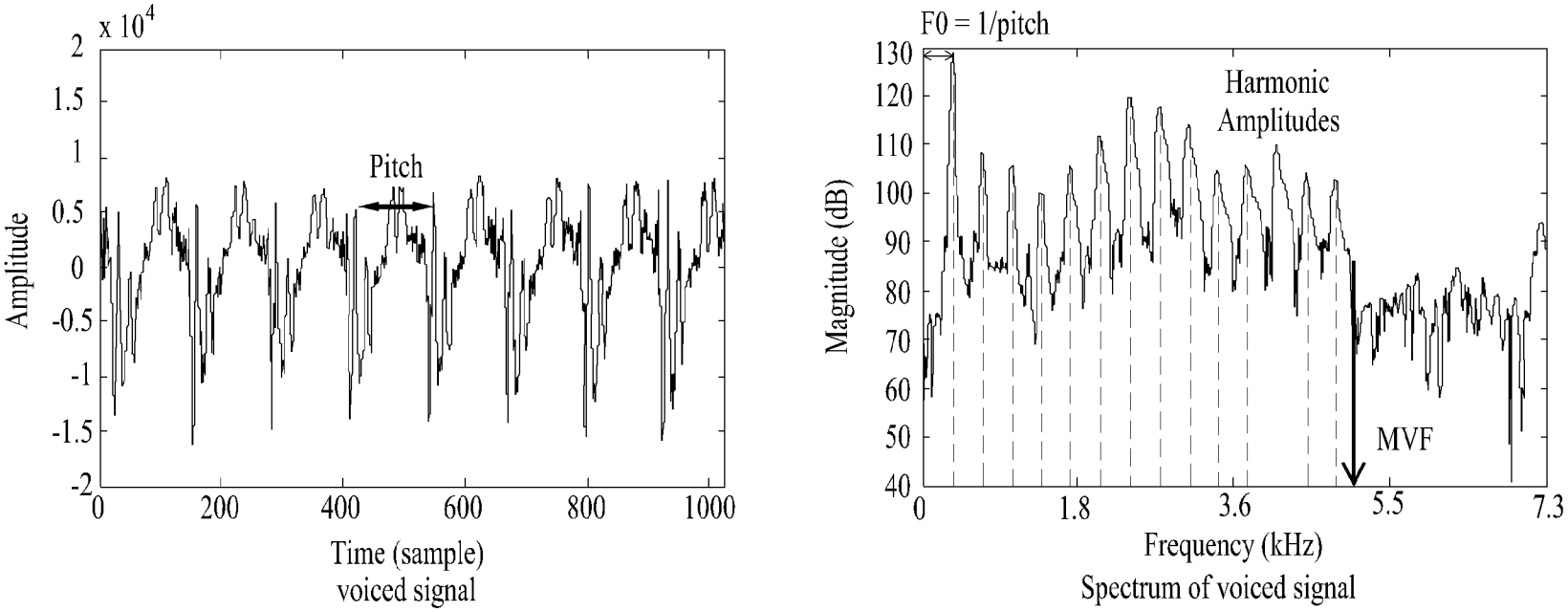
FIG. 3 is a graph illustrating harmonic information.

FIG. 3 is a graph illustrating harmonic information.

Harmonic information may be information used to eliminate a harmonic component generated when an instrument object is recovered from a down-mix signal using a spatial parameter. The harmonic information may include a pitch of a voiced signal included in a vocal object signal, a maximum harmonic frequency of the voiced signal, and spectrum harmonic magnitude of the voiced signal. Since most of vocal harmonics are generated by the voiced signal of the vocal object signal, the harmonic information may be information about the voiced signal.

Referring to FIG. 3, a graph (a left side of FIG. 3) in a time domain of a voiced signal and a graph (a right side of FIG. 3) in a frequency domain are shown.

In the left graph, an interval between pitches of spectrum harmonic magnitude of the voiced signal or a period of a pitch may be a pitch of the voiced signal.

In the right graph, a reciprocal number of the pitch of the voiced signal may be a fundamental frequency F0. Also, a maximum voiced frequency (MVF) may be a maximum harmonic frequency of the voiced signal. The MVF may indicate a frequency band in which harmonics are distributed. Also, a harmonic amplitude (HA) may be spectrum harmonic magnitude of the voiced signal. The HA may indicate harmonic magnitude.

Figure 4:
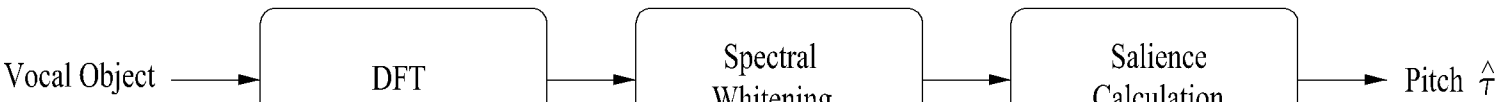
FIG. 4 is a flowchart illustrating a pitch extraction method according an embodiment.

FIG. 4 is a flowchart illustrating a pitch extraction method according an embodiment.

Referring to FIG. 4, a pitch may be extracted through discrete Fourier transform (DFT), spectral whitening, and salience of a vocal object signal. The pitch may be extracted based on usually used various methods. FIG. 4 illustrates a pitch extraction method using a salience function of Equation 3 below. Tau τ may be a candidate of a pitch value in Equation 3 below.

$$s(\tau) = \sum_{m=1}^{M} g(\tau, m) \max_{k \in k_{\tau,m}} |Y(k)| \quad \text{[Equation 3]}$$

Figure 5:
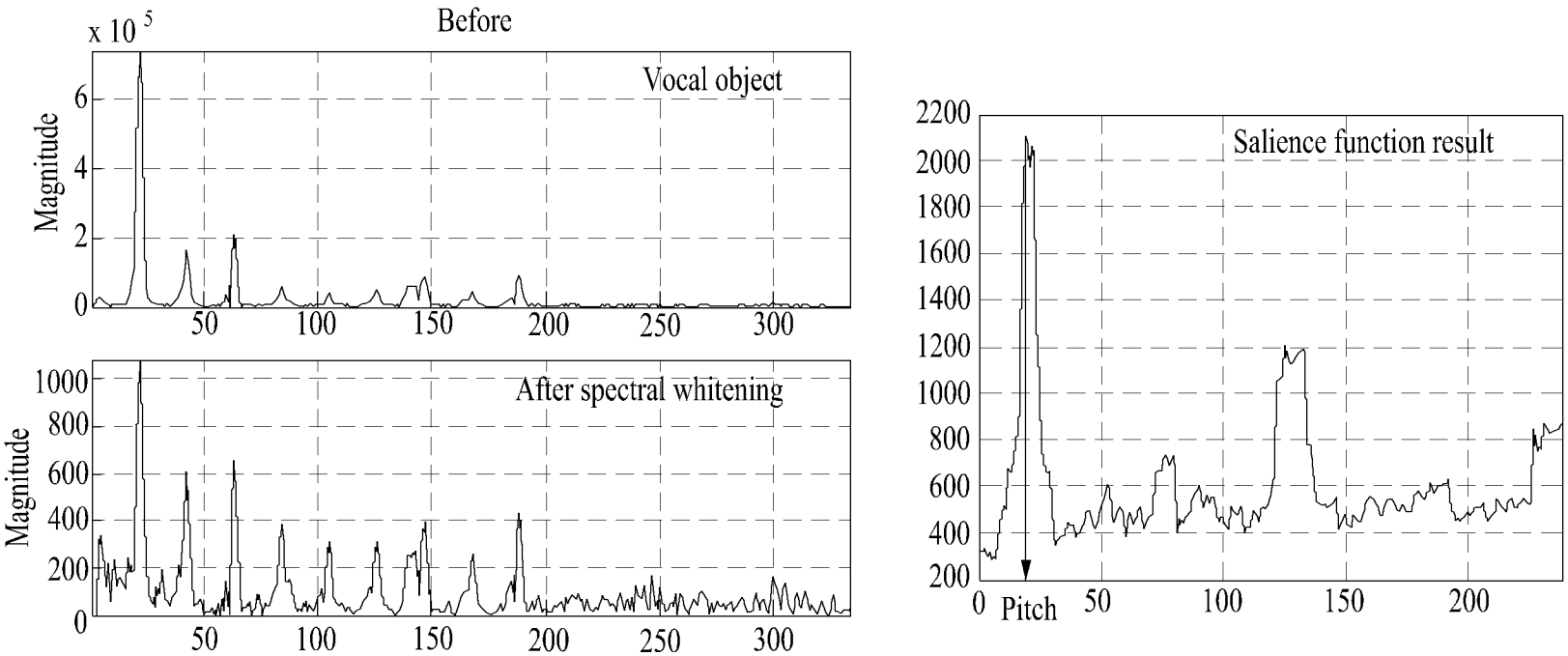
FIG. 5 is a graph according to a pitch extraction method of FIG. 4.

FIG. 5 is a graph according to a pitch extraction method of FIG. 4.

Referring to FIG. 5, a graph of a vocal object, a graph based on spectral whitening, and a graph based on a salience function result are shown. The graph based on the salience function result is a graph for a salience function based on tau τ of Equation 3. Herein, an index of a maximum value may be estimated at a pitch value.

Figure 6:
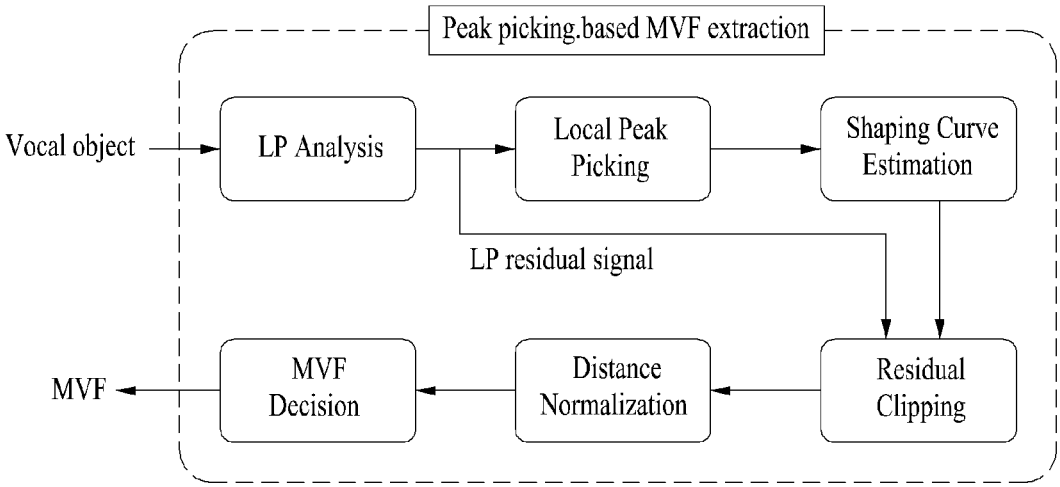
FIG. 6 is a flowchart illustrating a maximum voiced frequency (MVF) extraction method according an embodiment.

FIG. 6 is a flowchart illustrating an MVF extraction method according an embodiment.

A harmonic information generator 212 may use a linear predictive (LP) residual signal and may estimate an MVF by finding a harmonic peak on frequency. Each process shown in FIG. 6 will be described in detail with reference to FIG. 7.

Figure 7:
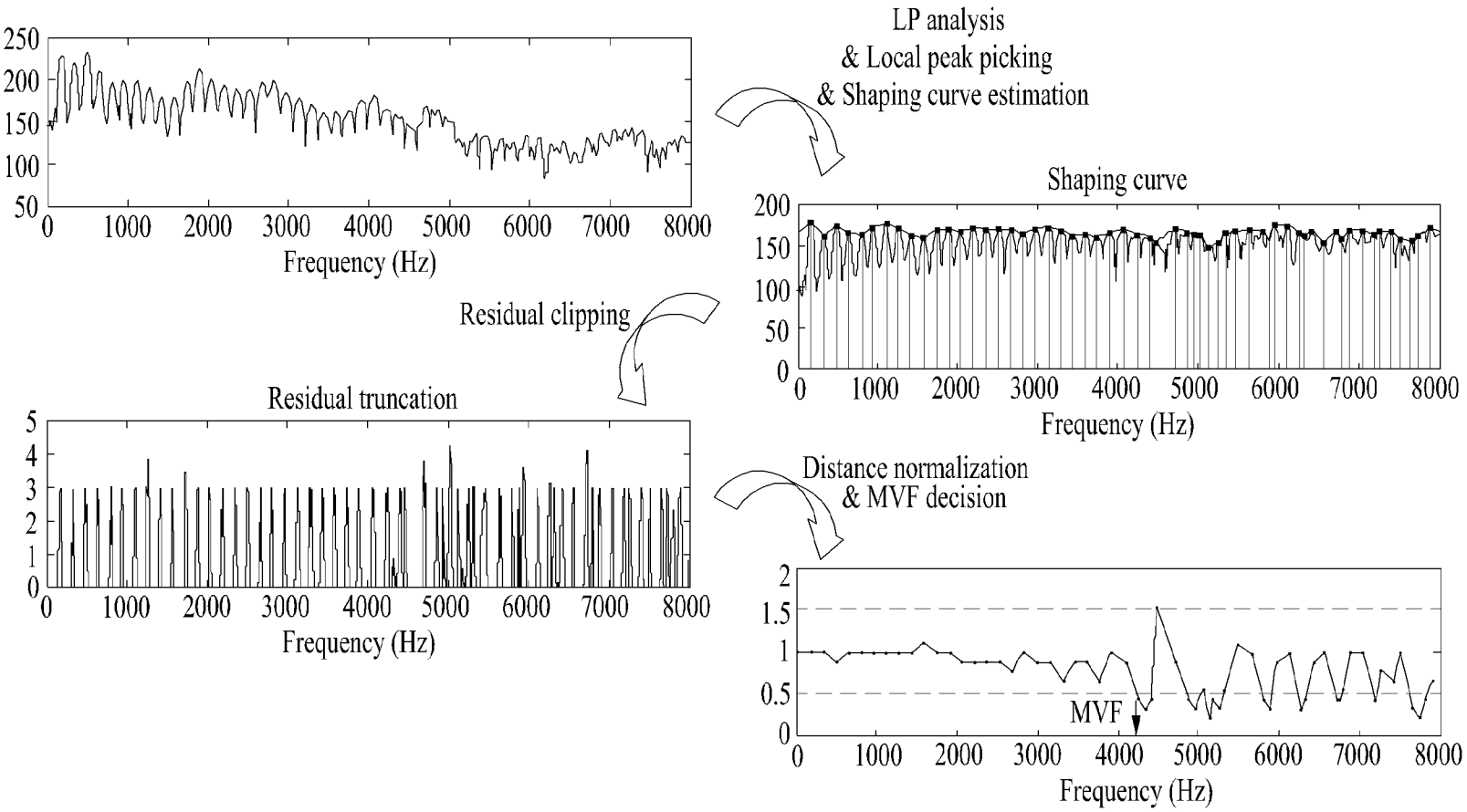
FIG. 7 is a graph according to an MVF extraction method of FIG. 6.

FIG. 7 is a graph according to an MVF extraction method of FIG. 6.

A harmonic information generator 212 may calculate an LP residual signal through an LP analysis of an input signal and may extract a local peak of a fundamental frequency interval. Also, the harmonic information generator 212 may estimate a shaping curve by performing linear interpolation of local peaks.

Next, the harmonic information generator 212 may truncate a residual signal by reducing the shaping curve by 3 decibels. The harmonic information generator 212 may normalize an interval between peak points of the truncated signal using a fundamental frequency and may estimate an MVF through MVF decision.

An embodiment shown in FIG. 7 may be a result of using 0.5 and 1.5 as a threshold value for determining an MVF.

Figure 8:
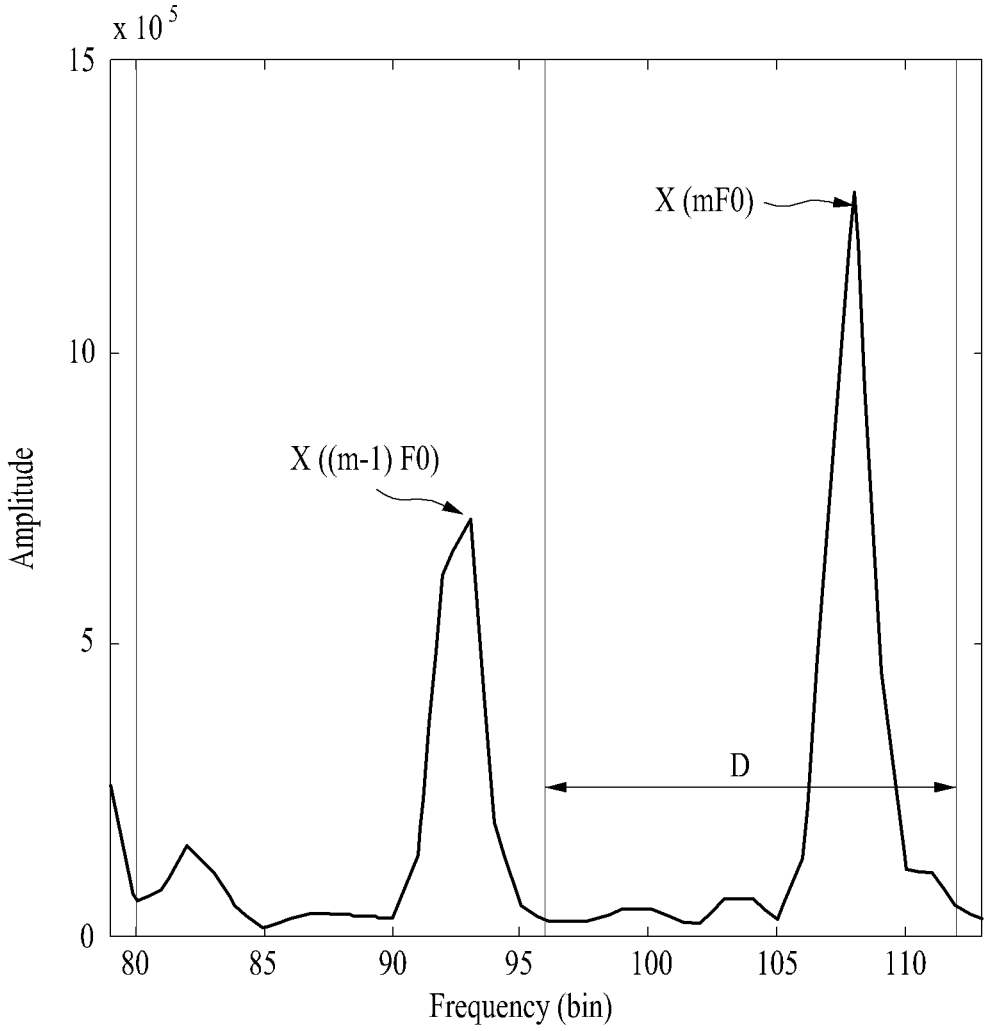
FIG. 8 is a graph for a harmonic amplitude (HA)

FIG. 8 is a graph for an HA.

A harmonic information generator 212 may calculate an HA from a power spectrum in a harmonic peak point.

Herein, since the HA has a variety of magnitude, there may be a need for quantization. For example, an adaptive quantization technique using an OLD parameter and an arithmetic mean may be used for the HA. A harmonic quantization table for the adaptive quantization technique may be generated using a maximum value and a minimum value calculated using Equations 4 to 6 below.

$$\frac{P_v(b)}{nD} \le X(mF0) \le P_v(b) \quad \text{[Equation 4]}$$

$$\log\left[\frac{P_v(b)}{D}\right] \le \log(X(mF0)) \le \log(P_v(b)) \quad \text{[Equation 5]}$$

$$1 - \frac{\log(D)}{\log(P_v(b))} \le \frac{\log(X(mF0))}{\log(P_v(b))} \le 1 \quad \text{[Equation 6]}$$

In FIG. 8, as shown in a right drawing, a minimum value and a maximum value in which an $m^{th}$ harmonic may be present to quantize an $m^{th}$ HA may be obtained as shown in Equations 4 to 6.

In Equation 4, the maximum value is Pv(b) which is $b^{th}$ sub-band power of a vocal signal. Also, the minimum value is Pv(b)/(nD) which is a mean of Pv(b). Herein, n may represent the number of harmonics included in a sub-and, and D may represent duration of the sub-band.

Equation 5 may be obtained by calculating a log formula for Equation 4. If Equation 5 is normalized, a minimum value and a maximum value of a quantization table may be obtained like Equation 6.

When the $m^{th}$ HA is quantized using the quantization table having the minimum value and the maximum value calculated based on Equations 4 to 6, a quantization error gain of 3.4 dB may be obtained compared with quantization which does not use the quantization table.

Figure 9:
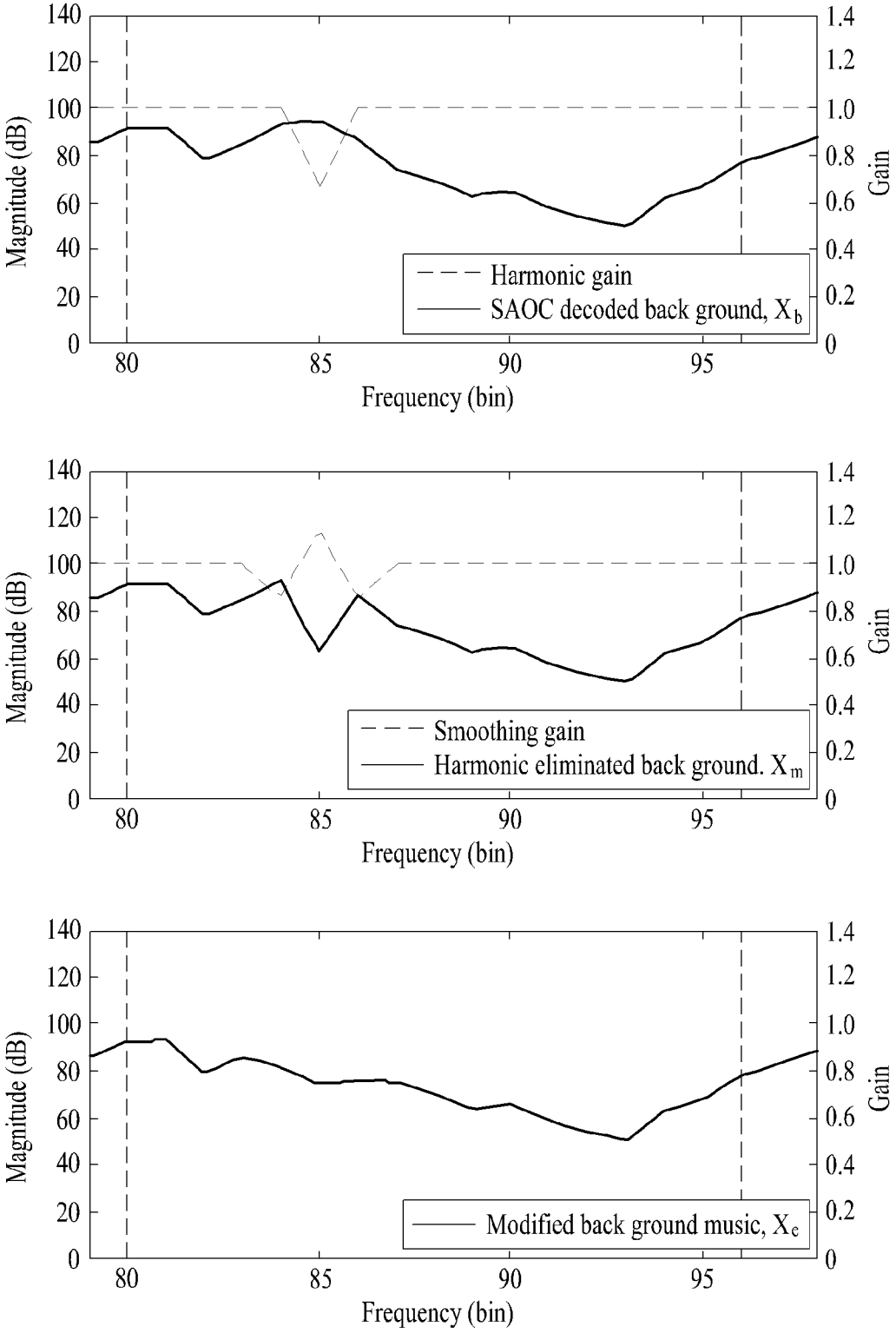
FIG. 9 is a graph illustrating a harmonic filtering process and a smoothing filtering process.

FIG. 9 is a graph illustrating a harmonic filtering process and a smoothing filtering process.

Referring to FIG. 9, a first graph of a harmonic gain for harmonic filtering, a second graph of a smoothing gain for smoothing filtering, and a third graph of a final result based on the harmonic filtering and the smoothing filtering are shown.

The first graph may be a graph indicating the harmonic gain for the harmonic filtering. Equation 7 below may represent a harmonic filtering unit 222.

$$\hat{X}_m(k)=G_E(k)X_{\hat{b}}(k) \quad \text{[Equation 7]}$$

In Equation 7, $\hat{X}_m(k)$ may represent an instrument object signal in which a harmonic component which is an output of a harmonic filter is eliminated. $\hat{X}_b(k)$ may represent a recovered instrument object signal which is an input of the harmonic filter. $G_E(k)$ may be a transfer function of the harmonic filter and may be designed based on Equation 8 below.

$$G_E(k)=\begin{cases}\sqrt{1-\dfrac{H^2(m)-|\hat{X}_v(k)|^2}{|\hat{X}_b(k)|^2}}, & k=m\times F0\\ 1, & \text{otherwise}\end{cases} \quad \text{[Equation 8]}$$

In Equation 8, $\hat{X}_v(k)$ may represent a recovered vocal object signal and $X_{\hat{b}}(k)$ may represent a recovered instrument object signal. An HA H(m) based on harmonic information may be a power spectrum of an $m^{th}$ harmonic in a frequency domain. H(m) may be defined using Equation 9 below.

$$H(m)=|X_v(mF_0)|^2,\ m=1,\ldots,M \quad \text{[Equation 9]}$$

Herein, $F_0$ may represent a fundamental frequency. m may be an integer. M may represent the number of harmonics. For example, M may be $<f_{mvf}/F_0>$. $f_{mvf}$ may represent an MVF. $X_v$ may represent a vocal object signal.

The second graph may be a graph indicating the smoothing gain for the smoothing filtering. Equation 10 below may represent a smoothing filtering unit 222.

$$\hat{X}_e(k)=\hat{X}_m(k)G_S(k) \quad \text{[Equation 10]}$$

In Equation 10, $\hat{X}_m(k)$ may represent an instrument object signal in which a harmonic component is removed, which is an output of the harmonic filter and an input of a smoothing filter. $\hat{X}_e(k)$ may represent a smoothed instrument object signal which is an output of the smoothing filter. $G_S(k)$ may represent a transfer function of the smoothing filter. $G_S(k)$ may be defined using Equation 11 below.

$$G_S(k)=\begin{cases}\dfrac{\sum_{q=-W/2}^{W/2}[\hat{X}_m(k+q)]^2}{W[\hat{X}_m(k)]^2}, & \lambda-\dfrac{W}{2}\le k\le\lambda+\dfrac{W}{2}\\ 1, & \text{otherwise}\end{cases} \quad \text{[Equation 11]}$$

Herein, W may represent a bandwidth of a harmonic based on a smoothing range. λ may be a value of an integer multiple for a fundamental frequency and may represent m*F0.

Figure 10:
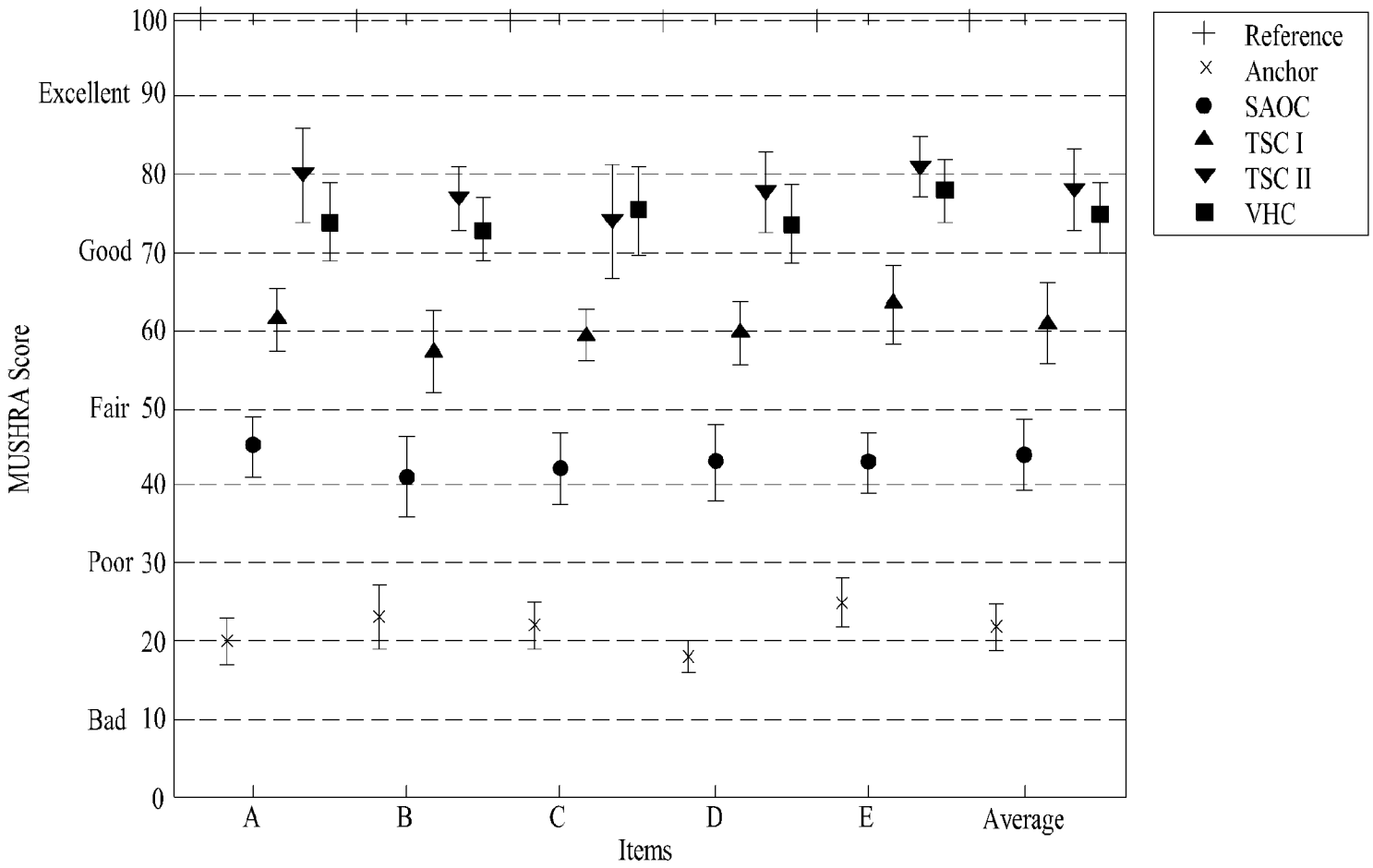
FIG. 10 is a graph illustrating a test result based on VHC.

FIG. 10 is a graph illustrating a test result based on voice harmonic coding (VHC).

Referring to FIG. 10, it may be seen that a score based on VHC is far higher than a score based on SAOC. Also, the VHC may have higher performance than two-step coding I (TSC I).

The VHC may have a lower score than TSC II. However, considering that a bit rate of the VHC is far lower than a bit rate of the TSC II, the VHC may be better than the TSC II in the entire performance.

Figure 11:
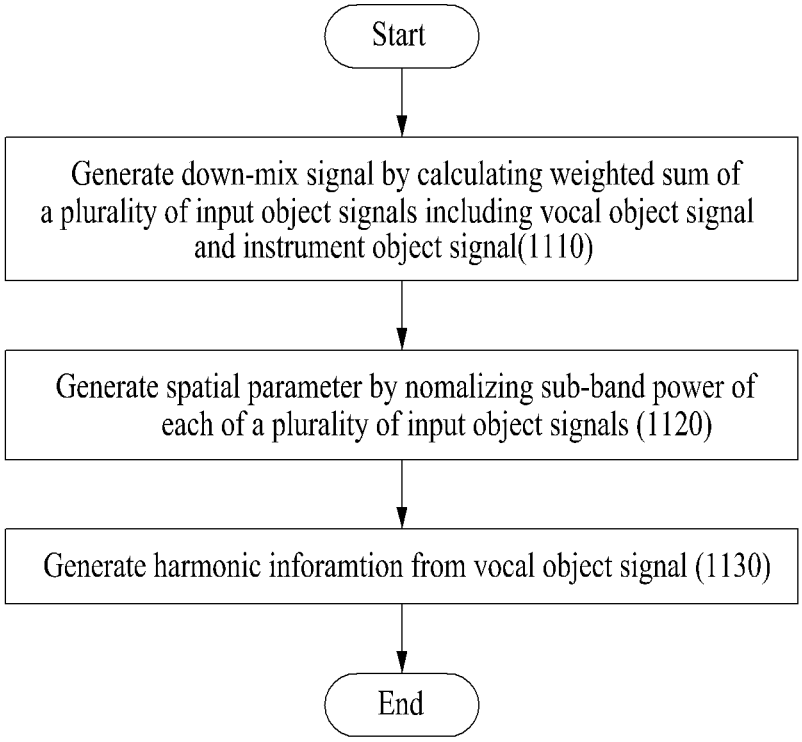
FIG. 11 is a flowchart illustrating an encoding method for VHC.

FIG. 11 is a flowchart illustrating an encoding method for voice harmonic coding.

Referring to FIG. 11, in step 1110, an encoding device may generate a down-mix signal by calculating a weighted sum of a plurality of input object signals including a vocal object signal and an instrument object signal.

In step 1120, the encoding device may generate a spatial parameter by normalizing sub-band power of each of the plurality of input object signals.

In step 1130, the encoding device may generate harmonic information from the vocal object signal. In this case, the harmonic information may include a pitch of a voiced signal included in the vocal object signal, a maximum harmonic frequency of the voiced signal, or spectrum harmonic magnitude of the voiced signal. The encoding device may generate the harmonic information by generating pitch information of the voiced information included in the vocal object signal, generating maximum harmonic frequency information of the voiced signal using the pitch information, and generating spectrum harmonic amplitude of the voiced signal using the pitch information and the maximum harmonic frequency information.

The encoding device may quantize the spectrum harmonic amplitude of the voiced signal included in the voice object signal using a quantization table calculated based on a mean value of sub-band power of the vocal object signal and sub-band power of the vocal object signal.

Figure 12:
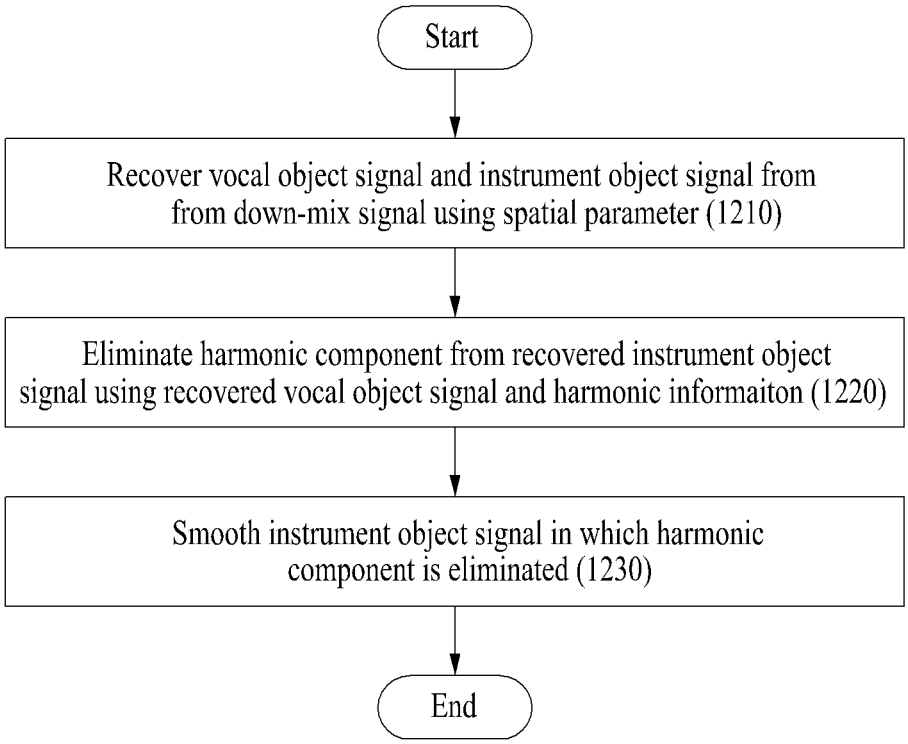
FIG. 12 is a flowchart illustrating a decoding method for VHC.

FIG. 12 is a flowchart illustrating a decoding method for voice harmonic coding.

Referring to FIG. 12, in step 1210, a decoding device may recover a voice object signal and an instrument object signal from a down-mix signal using a spatial parameter.

In step 1220, the decoding device may eliminate a harmonic component from the recovered instrument object signal using the recovered vocal object signal and harmonic information. Step 1220 may be performed through a harmonic filter. In this case, the harmonic information may include a pitch of a voiced signal included in the vocal object signal, a maximum harmonic frequency of the voiced signal, or spectrum harmonic magnitude of the voiced signal.

In step 1230, the decoding device may smooth the instrument object signal in which the harmonic component is removed, using a smoothing filter. The decoding device may generate an SAOC-decoded output using the recovered vocal object signal and the recovered instrument object signal.

3. Personal Audio Studio System

Figure 13:
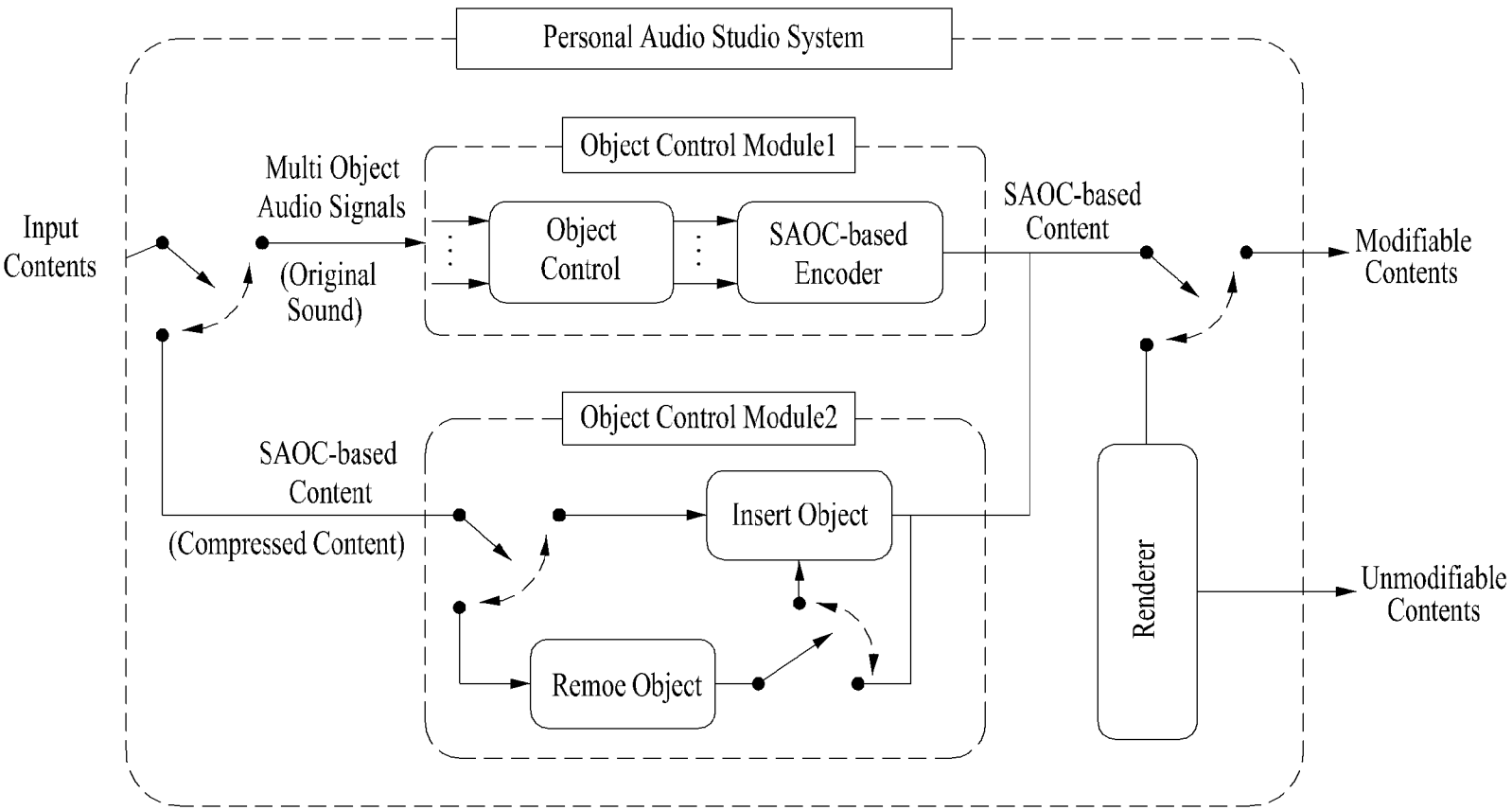
FIG. 13 is a block diagram illustrating a personal audio studio system according to an embodiment of the inventive concept.

FIG. 13 is a block diagram illustrating a personal audio studio system according to an embodiment of the inventive concept.

Referring to FIG. 13, the personal audio studio system according to an embodiment of the inventive concept may selectively receive input content as one of an original sound and compressed content. For example, a user may set the input content to which of the original sound and the compressed content. A selection unit (shown in the form of a switch) may select the input content as one of non-compressed input content and compressed content.

If the input content is the original sound including signals of each of several objects, the original sound may be input to an object control module 1. Meanwhile, if the input content is the compressed content, the compressed content may be input to an object control module 2. The object control module 1 may generate SAOC-based content which is the compressed content by compressing the original sound using one of SAOC, residual coding (RC), and VHC. The object control module 2 may perform at least one of object insertion, object addition, or object editing (e.g., addition after object removal) with respect to the compressed content in a compressed state.

A detailed description for this will be given below.

Figure 14:
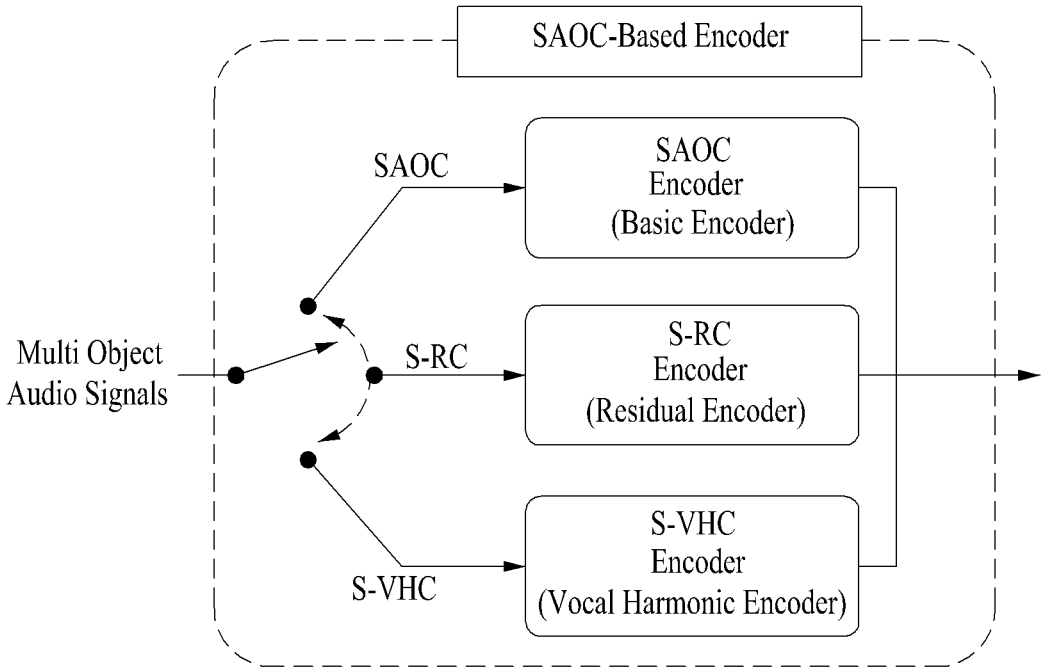
FIG. 14 is a block diagram illustrating an encoding device for selectively using one of SAOC, residual coding (RC), and VHC.

FIG. 14 is a block diagram illustrating an encoding device for selectively using one of SAOC, RC, and VHC.

Referring to FIG. 14, the object control module 1 shown in FIG. 13 may include an SAOC-based encoder. The SAOC-based encoder may selectively use one of several coding methods.

In detail, the SAOC-based encoder may selectively use one of SAOC, RC, and VHC. An SAOC encoder and an SAOC-VHC (S-VHC) encoder (or a vocal harmonic encoder) may be as described above. A detailed description will be given below of an S-RC encoder (or a residual encoder).

Herein, characteristics of the SAOC encoder, the S-VHC encoder (or the vocal harmonic encoder), and the S-RC encoder (or the residual encoder) may be represented as shown in the table below.

| Mode | Output | Properties |
|---|---|---|
| SAOC | Down-mix signal | Very low bit-rate |
| | OLD | Poor quality |
| S-RC | Down-mix signal | High bit-rate |
| | OLD | Good quality |
| | Residual signal | |
| S-VHC | Down-mix signal | Low bit-rate |
| | OLD | Good quality |
| | Harmonic Info. | Karaoke service |

In other words, the SAOC encoder may have a down-mix signal and an OLD as its outputs and may have a very low bit rate and a low quality. The vocal harmonic encoder may have a down-mixed signal, an OLD, and harmonic information as its outputs, may have a low bit rate and a relatively good quality, and may have characteristics suitable for a Karaoke service. The S-RC encoder (or the residual encoder) may have a down-mix signal, an OLD, and a residual signal as its outputs and may have a high bit rate and a relatively good quality.

4. Residual Encoder

Figure 15:
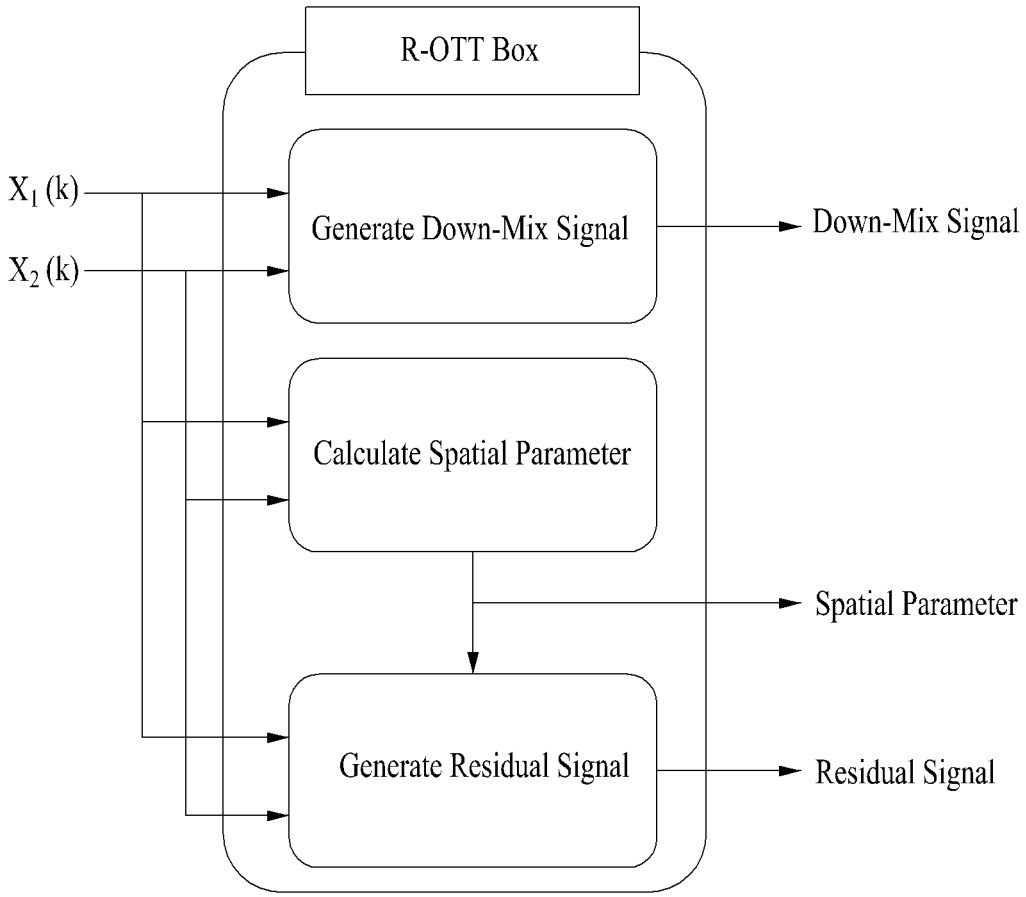
FIG. 15 is a block diagram illustrating an encoding device for performing RC according to an embodiment of the inventive concept.

FIG. 15 is a block diagram illustrating an encoding device for performing residual coding according to an embodiment of the inventive concept.

Referring to FIG. 15, a residual encoder according to an embodiment of the inventive concept may use the concept of moving picture experts group (MPEG) RC and may have a down-mix signal, an OLD, and a residual signal for each object as its outputs.

The residual encoder according to an embodiment of the inventive concept may be based on an SAOC technique and may use an MPEG surround RC technique. An R-over-the-top (R-OTT) box shown in FIG. 15 may include a down-mix signal generator, a spatial parameter (OLD) calculating unit, and a residual signal generator.

Contents described in connection with an SAOC encoder may be applied to the down-mix signal generator and the spatial parameter calculating unit. The down-mix signal generator and the spatial parameter calculating unit may generate and calculate a down-mix signal and an OLD based on the contents. Therefore, a detailed description for the down-mix signal generator and the spatial parameter calculating unit will be omitted below.

It is assumed that there are two input signals $X_1(k)$ and $X_2(k)$ in an original sound including audio signals of a plurality of objects. In this case, the down-mix signal generator may generate a down-mix signal $X_d(k)$ through a linear combination of the two input signals. The down-mix signal $X_d(k)$ may have coefficients c1 and c2 and may have an out-of-phase component $X_r(k)$.

In this case, the two input signals $X_1(k)$ and $X_2(k)$ may be represented as shown in the formula below.

$$X_1(K)=c_1X_d(k)+X_r(k)$$

$$X_2(K)=c_2X_d(k)-X_r(k)$$

The down-mix signal $X_d(k)$ is as shown in the formula below.

$$X_d(k)=(X_1(k)+X_2(k))/(c_1+c_2)$$

In this case, the coefficients $c_1$ and $c_2$ may be configured such that the down-mix signal meets an energy conservation constraint. An energy of $X_d(k)$ may be the same as the sum of an energy of $X_1(k)$ and an energy of $X_2(k)$.

In this case, the above-mentioned formula is as shown in the formula below.

$$\begin{bmatrix} X_1(k) \\ X_2(k) \end{bmatrix} = \begin{bmatrix} c_1(b) & 1 \\ c_2(b) & -1 \end{bmatrix} \begin{bmatrix} X_d(k) \\ X_r(k) \end{bmatrix}$$

$$\begin{bmatrix} X_d(k) \\ X_r(k) \end{bmatrix} = \frac{1}{c_1(b)+c_2(b)} \begin{bmatrix} 1 & 1 \\ c_2(b) & -c_1(b) \end{bmatrix} \begin{bmatrix} X_1(k) \\ X_2(k) \end{bmatrix}$$

In this case, the coefficients $c_1$ and $c_2$ may be calculated as shown in the formula below by a spatial parameter CLD.

$$c_{1,b} = \sqrt{\frac{1}{1+10^{\frac{CLD_b}{10}}}},$$

$$c_{2,b} = \sqrt{\frac{10^{\frac{CLD_b}{10}}}{1+10^{\frac{CLD_b}{10}}}},$$

In this case, a residual signal may be calculated as shown in the formula below.

$$X_r(k) = \frac{c_2X_1(k) - c_1X_2(k)}{c_1 + c_2}$$

Summarizing the above-mentioned formulas, the residual signal may be represented as shown in the formula below.

$$X_r(k) = \frac{X_1(k)\sqrt{\frac{10^{\frac{CLD_b}{10}}}{1+10^{\frac{CLD_b}{10}}}} - X_2(k)\sqrt{\frac{1}{1+10^{\frac{CLD_b}{10}}}}}{\sqrt{\frac{1}{1+10^{\frac{CLD_b}{10}}}} + \sqrt{\frac{10^{\frac{CLD_b}{10}}}{1+10^{\frac{CLD_b}{10}}}}}$$

Finally, to sum up, the residual encoder shown in FIG. 15 may generate the down-mix signal, the spatial parameter, and the residual signal. In detail, the down-mix signal generator may generate the down-mix signal $X_d(k)$ as shown in the formula below.

$$X_d(k) = \sum_{i=1}^{N} X_i(k)$$

The spatial parameter calculating unit may calculate an OLD which is a spatial parameter for each object as shown in the formula below.

$$OLD_i(b) = \frac{P_i(b)}{\max_{1 \le j \le N} P_j(b)}, \quad \begin{matrix} i = 1, \ldots, N \\ b = 1, \ldots, B \end{matrix},$$

Herein, i may represent an index of an object in input content. B may represent the number of parameter sub-bands. N may represent the number of objects in the input content. $P_i(b)$ may represent sub-band power in a $b^{th}$ sub-band of an $i^{th}$ object and may be defined as shown in the formula below.

$$P_i(b) = \sum_{k=A_b-1}^{A_b-1} |X_i(k)|^2$$

Herein, Ab may represent a $b^{th}$ sub-band partition boundary.

The CLD used above may be replaced with an OLD as shown in the formula below.

$$c_{1,b} = \sqrt{1 - \frac{OLD_{i,b}}{\sum_{j=1}^{N} OLD_{j,b}}},$$

$$c_{2,b} = \sqrt{\frac{OLD_{i,b}}{\sum_{j=1}^{N} OLD_{j,b}}},$$

Finally, according to an embodiment of the inventive concept, the residual signal may be generated using the spatial parameter OLD calculated by the spatial parameter calculating unit as shown in the formula below, without the necessity of separately calculating the CLD.

$$X_{r,i}(k) = \frac{X_{d,i}(k)\sqrt{\frac{OLD_{i,b}}{\sum_{j=1}^{N} OLD_{j,b}}} - X_i(k)\sqrt{1 - \frac{OLD_{i,b}}{\sum_{j=1}^{N} OLD_{j,b}}}}{\sqrt{1 - \frac{OLD_{i,b}}{\sum_{j=1}^{N} OLD_{j,b}}} + \sqrt{\frac{OLD_{i,b}}{\sum_{j=1}^{N} OLD_{j,b}}}}$$

Figure 16:
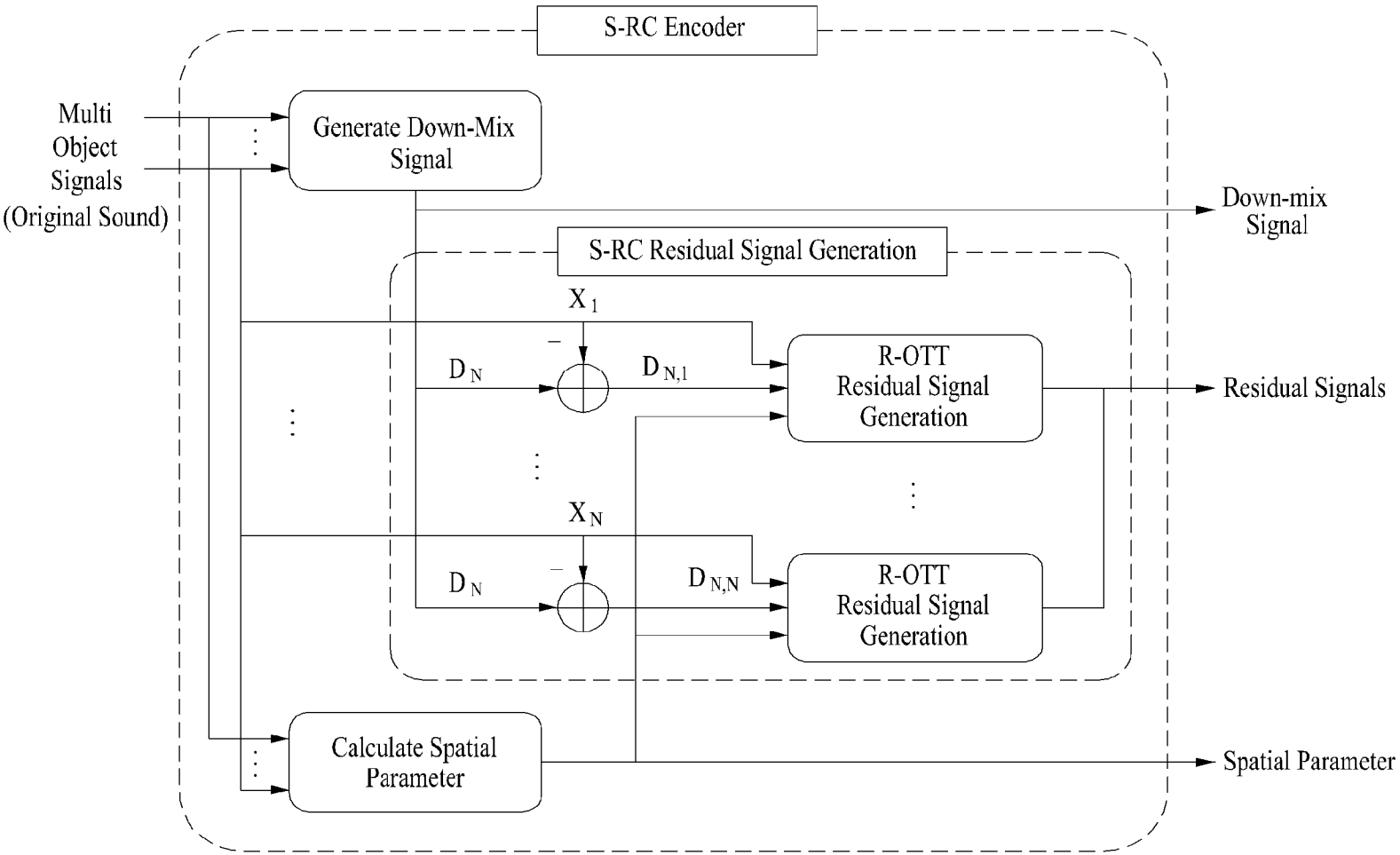
FIG. 16 is a block diagram illustrating a detailed configuration of a residual signal generator shown in FIG. 15.

FIG. 16 is a block diagram illustrating a detailed configuration of a residual signal generator shown in FIG. 15.

Referring to FIG. 16, a residual encoder may receive an original sound including audio signals for a plurality of objects and may generate a down-mix signal. The generated down-mix signal may be provided to a residual signal generator and a spatial parameter calculating unit. The spatial parameter calculating unit may calculate an OLD for each object.

Also, the down-mix signal and the calculated OLD for each object may be provided to the residual signal generator. The residual signal generator may generate a residual signal for each object based on the formula below, defined above.

Figure 17:
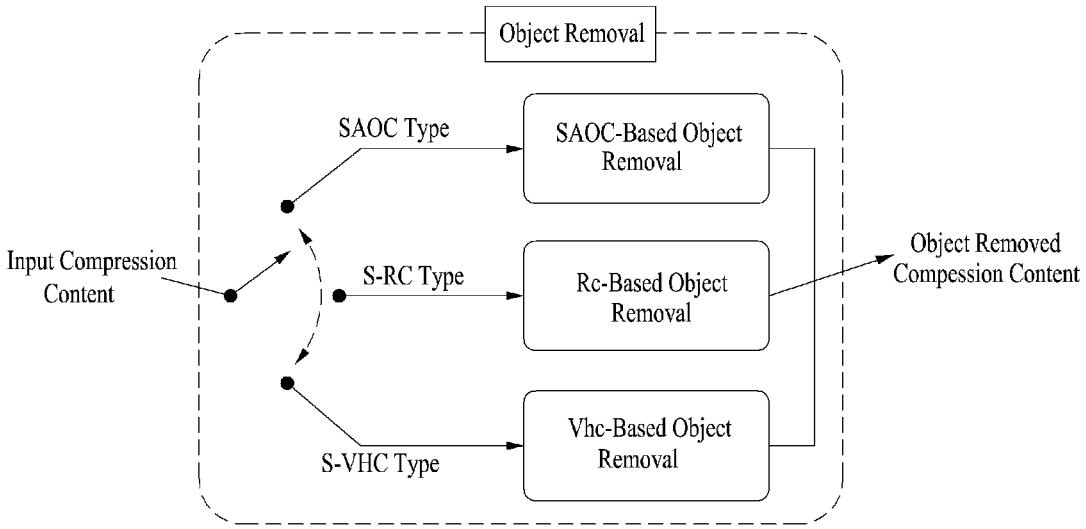
FIG. 17 is a block diagram illustrating a detailed configuration of an object removal module included in an object control module 2 shown in FIG. 17.

FIG. 17 is a block diagram illustrating a detailed configuration of an object removal module 2 shown in FIG. 13.

Referring again to FIG. 13, compressed content may be provided to the object control module 2. The object control module 2 may remove at least one of a plurality of objects in the compressed state without decompressing the compressed content or may newly add at least one object. Herein, since adding of another object after removing the object is substantially the same to editing of an object, object editing may be performed by combining object removal with object insertion.

In an embodiment of the inventive concept, a specific object signal may be removed based on whether compression content including a plurality of object signals is compressed based on any coding technique. For example, the compression content may be compressed by one of SAOC, RC, and VHC described above. In this case, a user may select a mode for object removal based on a coding scheme of the compression content or his or her preference.

Figure 18:
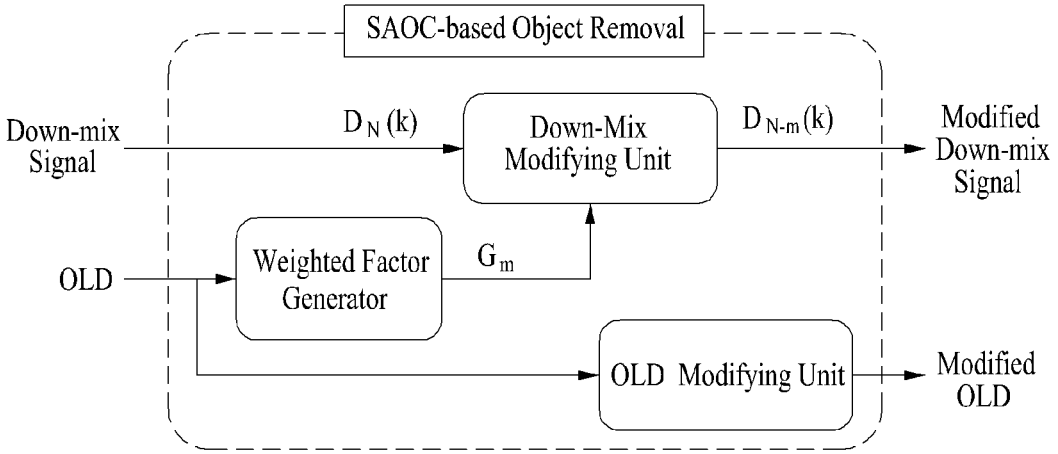
FIG. 18 is a block diagram illustrating an SAOC-based object removal module according to an embodiment of the inventive concept.

FIG. 18 is a block diagram illustrating an SAOC-based object removal module according to an embodiment of the inventive concept.

Referring to FIG. 18, the SAOC-based object removal module may generate a modified down-mix signal $D_{N-m}(k)$ by modifying a down-mix signal $D_N(k)$. In this case, $D_{N-m}(k)$ may be defined as shown in the formula below.

$$D_{N-m}(k) = D_N(k)\sqrt{1 - \frac{OLD_m(b)}{\sum_{j=1}^{N} OLD_j(b)}}$$

In this case, a weight factor G may be defined as shown in the formula below.

$$G_i = \sqrt{1 - \frac{OLD_{i,b}}{\sum_{j=1}^{N} OLD_{j,b}}}$$

Herein, i may represent an index of a removed object.

In other words, a down-mix modifying unit may generate a modified down-mix signal based on an input down-mix signal and the weighted factor. A weighted factor generator may generate a weighted factor based on an input OLD.

Also, an OLD modifying unit may modify an OLD of each of objects based on whether an OLD of a removed object is the largest OLD.

For example, if OLDs of three objects are 1.0, 0.6, and 0.9 and if an object corresponding to 1.0 is removed, 0.6 may be modified to 0.6/0.9 and 0.9 may be modified to 0.9/0.9. In other words, the other OLDs may be standardized based on the largest OLD except for an OLD corresponding to the removed object. Meanwhile, if 0.6 is removed, since 0.6 is not the largest OLD, 1.0 and 0.9 may be maintained without change.

As such, the SAOC-based object removal according to an embodiment of the inventive concept may be simply performed by modifying the down-mix signal using the weighted factor generated based on the removed object as well as modifying the OLD of the removed object.

Figure 19:
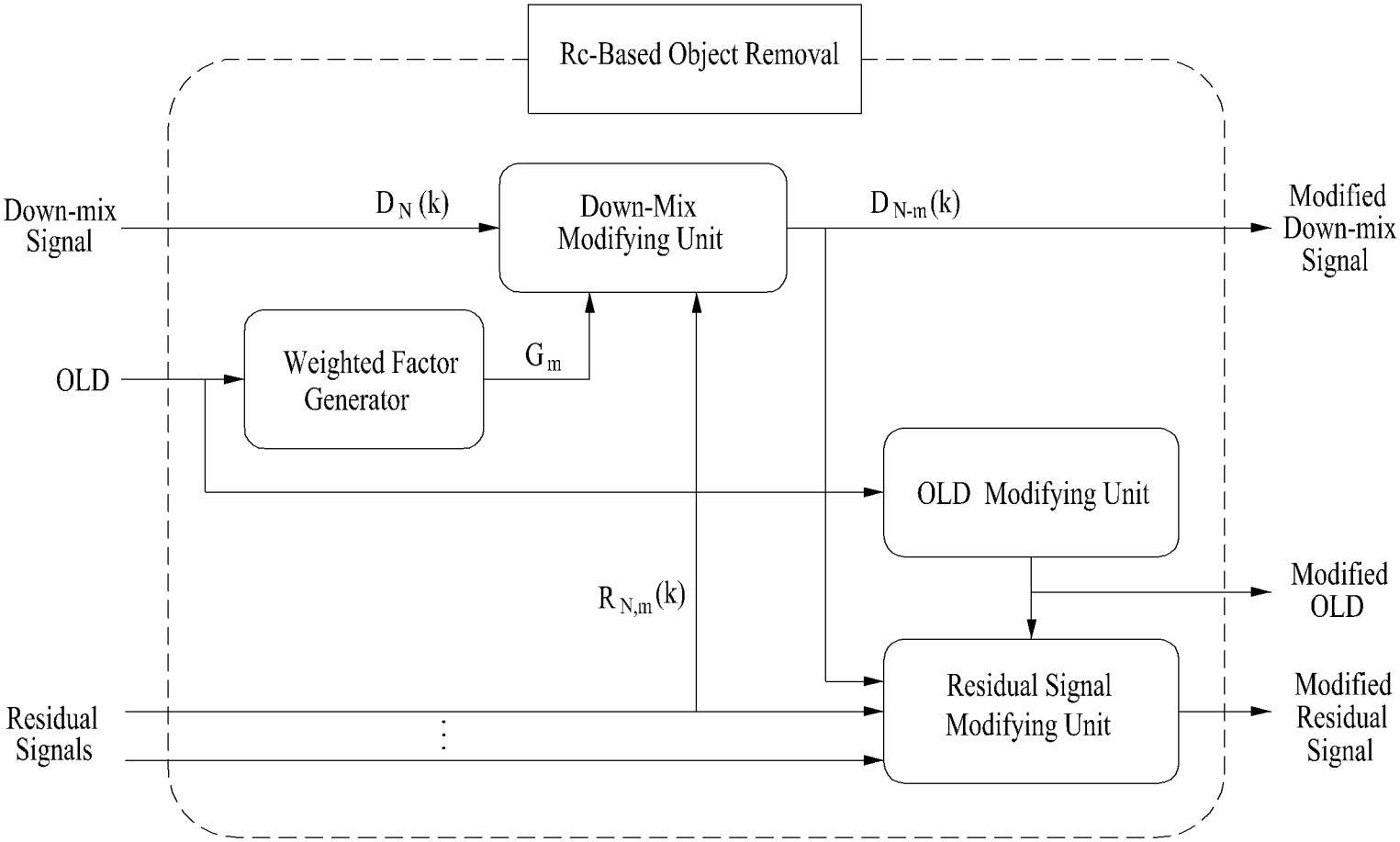
FIG. 19 is a block diagram illustrating an RC-based object removal module.

FIG. 19 is a block diagram illustrating an RC-based object removal module.

Referring to FIG. 19, if content including a plurality of objects, compressed by RC is input, the compressed content may include a down-mix signal, an OLD, and a residual signal.

In this case, a down-mix modifying unit included in the RC-based object removal module may generate a modified down-mix signal $D_{N-m}(k)$ by modifying a down-mix signal $D_N(k)$. In this case, $D_{N-m}(k)$ may be defined as shown in the formula below.

$$D_{N-m}(k) = D_N(k)\sqrt{1 - \frac{OLD_m(b)}{\sum_{j=1}^{N} OLD_j(b)}} + R_{N,m}(k)$$

In other words, the down-mix modifying unit may generate $D_{N-m}(k)$ using a weighted factor $G_m$ defined by the OLD and the residual signal. The weighted factor may be represented as shown in the formula below.

$$G_j = \sqrt{1 - \frac{OLD_{j,b}}{\sum_{m=1}^{N} OLD_{m,b}}}$$

Also, a weighted factor generator and an OLD modifying unit may generate the weighted factor in the same manner as contents described with reference to FIG. 17 and may modify the OLD, respectively.

A residual signal modifying unit may modify a residual signal based on the following formula below.

$$R_{N-1,i}(k) = R_{N,i}(k)\left(\frac{c_1 + c_2}{c_1' + c_2'}\right)\left(\frac{c_1'}{c_1}\right) - c_2\frac{c_1'}{c_1}D_{N,i}(k) + c_2'D_{N-1}$$

Herein, $c_1'$ and $c_2'$ may be weighted factors newly calculated by the modified OLD. A modified down-mix signal and a modified residual signal may have the following relationship.

$$\begin{bmatrix} D_{N-1}(k) \\ R_{N-1,i}(k) \end{bmatrix} = \frac{1}{c_1' + c_2'}\begin{bmatrix} 1 & 1 \\ c_2' & -c_1' \end{bmatrix}\begin{bmatrix} D_{N-1,i}(k) \\ X_i(k) \end{bmatrix}$$

Figure 20:
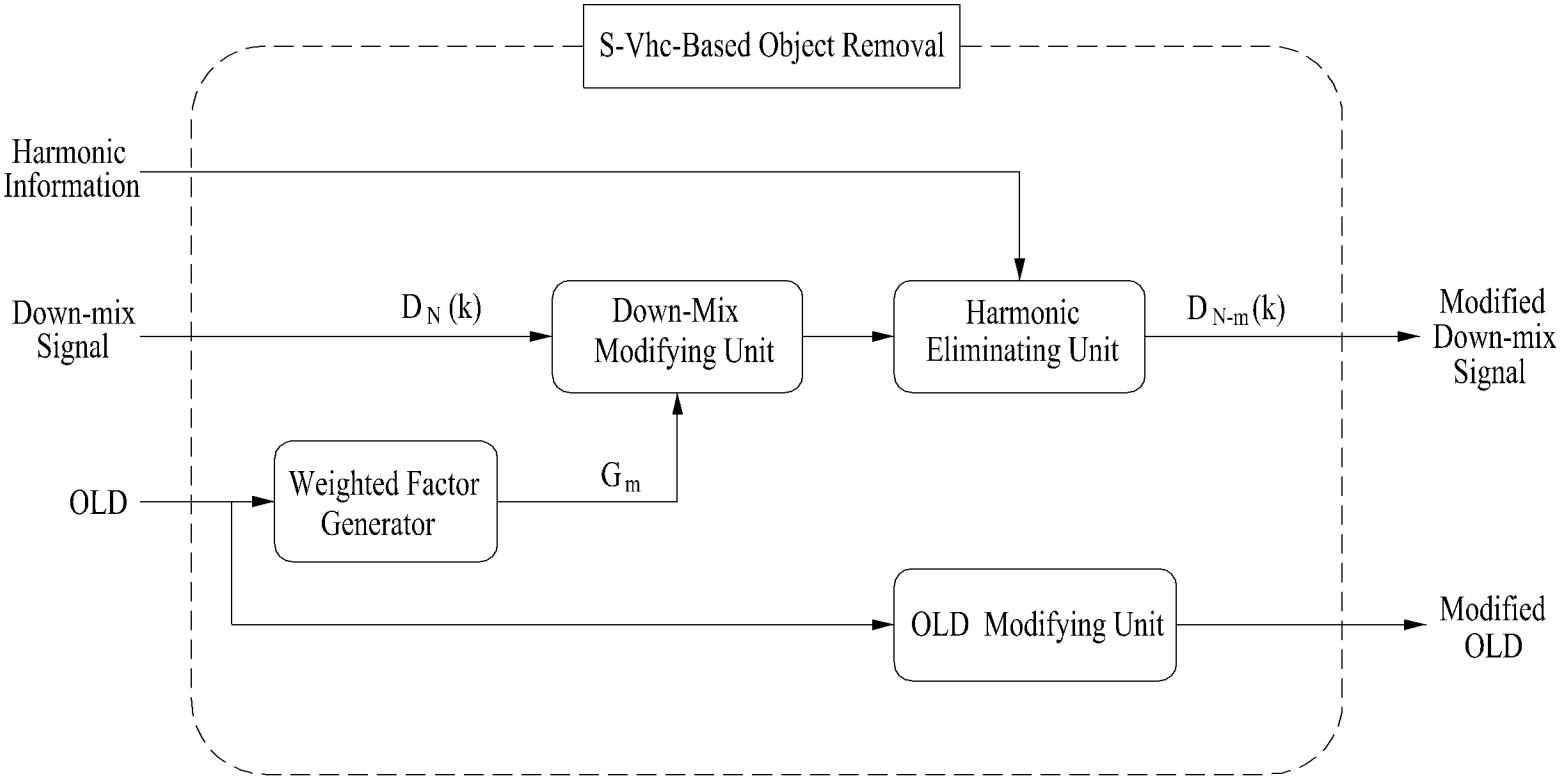
FIG. 20 is a block diagram illustrating a VHC-based object removal module according to an embodiment of the inventive concept.

FIG. 20 is a block diagram illustrating a VHC-based object removal module according to an embodiment of the inventive concept.

Referring to FIG. 20, if a vocal signal is eliminated, a background signal $\hat{X}_b$ (k) modified by a down-mix modifying unit is as shown in the formula below.

$$\hat{X}_b(k) = X_d(k)\sqrt{1 - \frac{OLD_v}{\sum_{j=1}^{N} OLD_j}}$$

Herein, v may be an index of the vocal signal.

In this case, a weighted factor $G_m$ generated by a weighted factor generator may be provided to a down-mix modifying unit. A harmonic eliminating unit may eliminate a harmonic using the following harmonic eliminating filter.

$$G_E(k) = \begin{cases} \sqrt{1 - \frac{H^2(m) - |\hat{X}_v(k)|^2}{|\hat{X}_b(k)|^2}}, & k = m \times F0 \\ 1, & \text{otherwise} \end{cases}$$

Also, the following smoothing filter may be additionally used.

$$G_S(k) = \begin{cases} \frac{\sum_{q=-W/2}^{W/2} [\hat{X}_m(k+q)]^2}{W[\hat{X}_m(k)]^2}, & \lambda - \frac{W}{2} \le k \le \lambda + \frac{W}{2} \\ 1, & \text{otherwise} \end{cases}$$

Herein, W may be a harmonic bandwidth and may represent a smoothing range. λ may be defined by multiplying a fundamental frequency by an integer.

Finally, after a harmonic is eliminated from an output of a down-mix modifying unit, if the smoothing filter is applied to the output in which the harmonic is eliminated, a finally modified down-mix signal may be output. An OLD modifying unit may modify an OLD based on contents described with reference to FIGS. 18 and 19.

Figure 21:
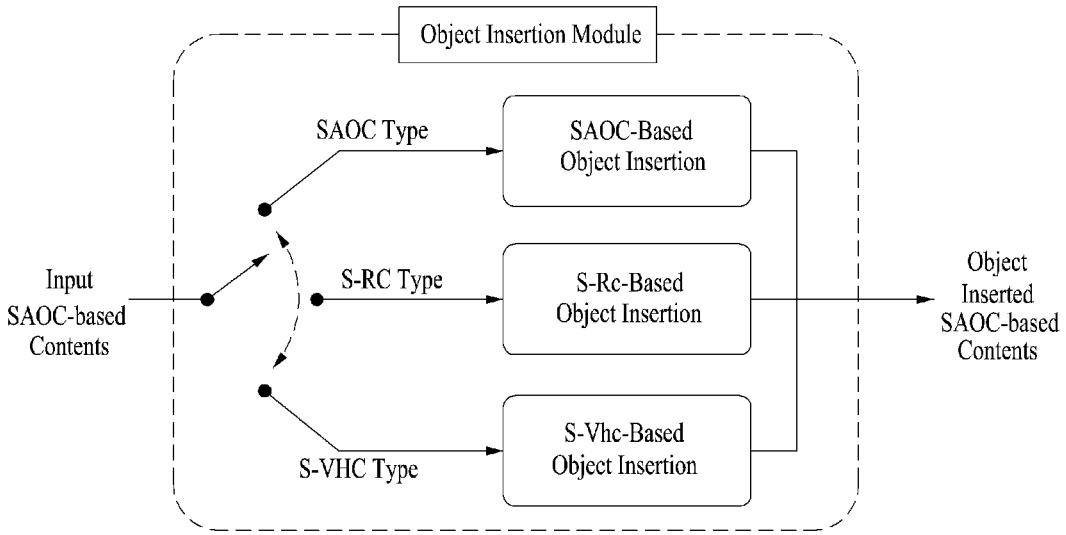
FIG. 21 is a block diagram illustrating an object addition (insertion) module according to an embodiment of the inventive concept.

FIG. 21 is a block diagram illustrating an object addition (insertion) module according to an embodiment of the inventive concept.

Referring to FIG. 21, in an embodiment of the inventive concept, a specific object signal may be inserted based on whether compression content including a plurality of object signals is compressed based on any coding technique. For example, the compression content may be compressed by one of SAOC, RC, and VHC described above. In this case, a user may select a mode for object insertion based on a coding scheme of the compression content or his or her preference.

Figure 22:
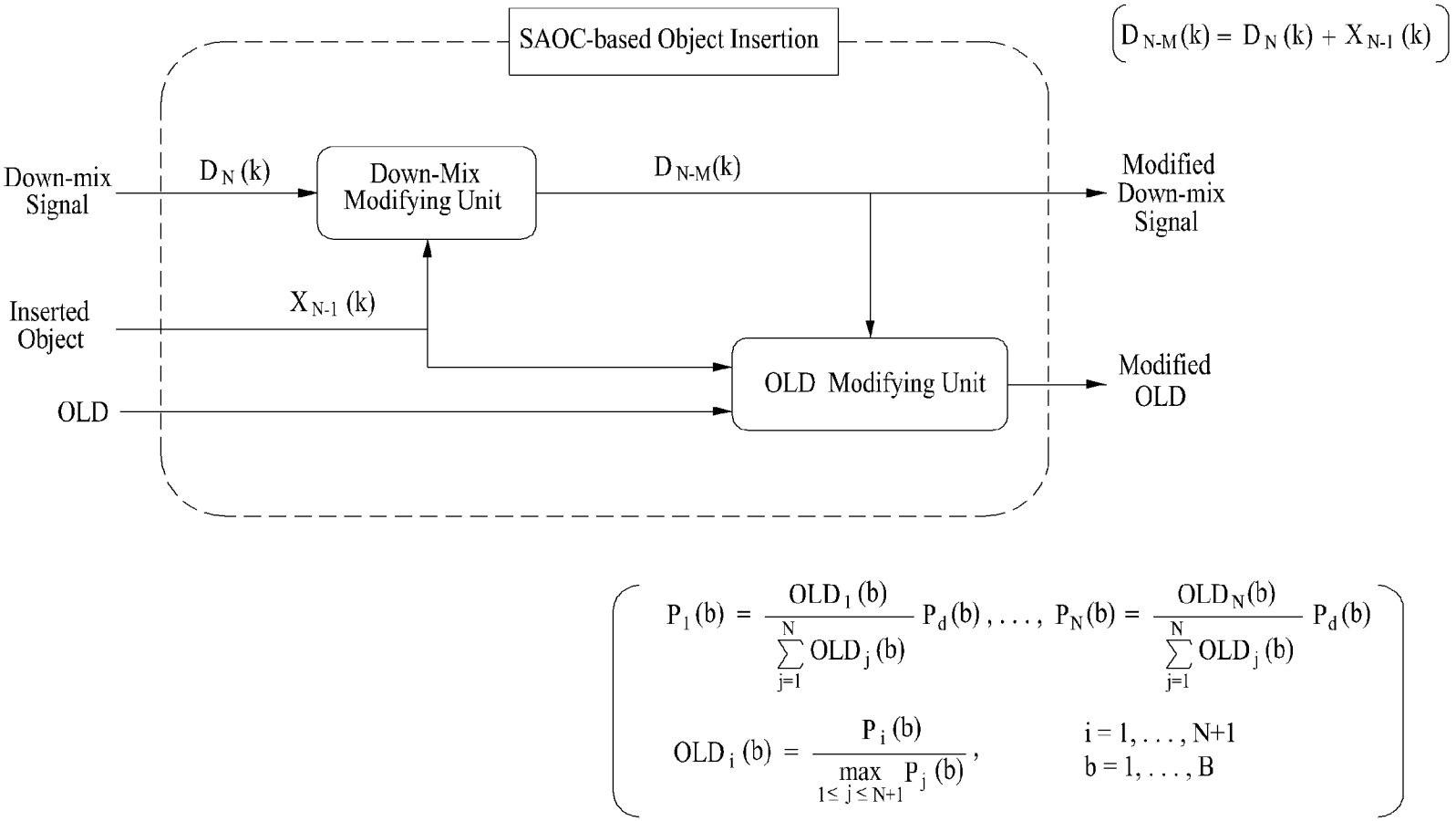
FIG. 22 is a block diagram illustrating an SAOC-based object addition module according to an embodiment of the inventive concept.

FIG. 22 is a block diagram illustrating an SAOC-based object addition module according to an embodiment of the inventive concept.

Referring to FIG. 22, a down-mix modifying unit may generate a modified down-mix signal $D_{N-m}(k)$ by modifying a down-mix signal $D_N(k)$ based on an inserted object signal $X_{N+1}(k)$. In this case, an OLD may be modified based on the inserted object signal $X_{N+1}(k)$ as shown in the formula below.

$$P_1(b) = \frac{OLD_1(b)}{\sum_{j=1}^{N} OLD_j(b)}P_d(b), \ldots, P_N(b) = \frac{OLD_N(b)}{\sum_{j=1}^{N} OLD_j(b)}P_d(b)$$

$$OLD_i(b) = \frac{P_i(b)}{\max_{1 \le j \le N+1} P_j(b)}, \quad i = 1, \ldots, N+1, \quad b = 1, \ldots, B$$

Figure 23:
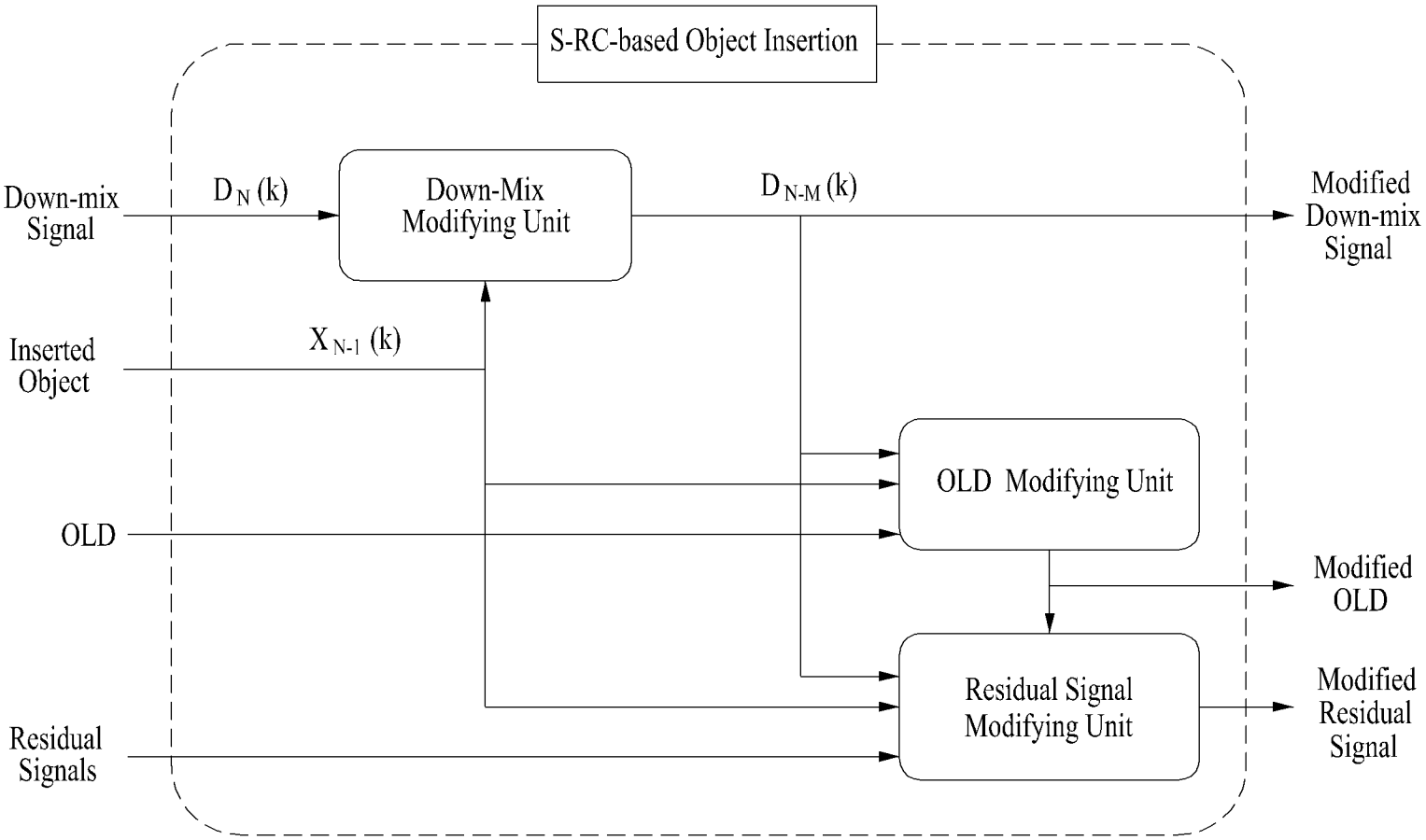
FIG. 23 is a block diagram illustrating an RC-based object insertion module.

FIG. 23 is a block diagram illustrating an RC-based object insertion module.

Referring to FIG. 23, a down-mix modifying unit may generate a modified down-mix signal $D_{N-m}(k)$ by modifying a down-mix signal $D_N(k)$ based on an inserted object signal $X_{N+1}(k)$. In this case, as described with reference to FIG. 22, an OLD modifying unit may modify an OLD based on the inserted object signal $X_{N+1}(k)$.

Also, a residual signal modifying unit may generate a modified residual signal as shown in the formula below.

$$R_{N+1,i}(k) = R_{N,i}(k)\left(\frac{c_1 + c_2}{c_1' + c_2'}\right)\left(\frac{c_1'}{c_2'}\right) - c_2\frac{c_1'}{c_1}D_{N,i}(k) + c_2'D_{N+1,i}(k)$$

Figure 24:
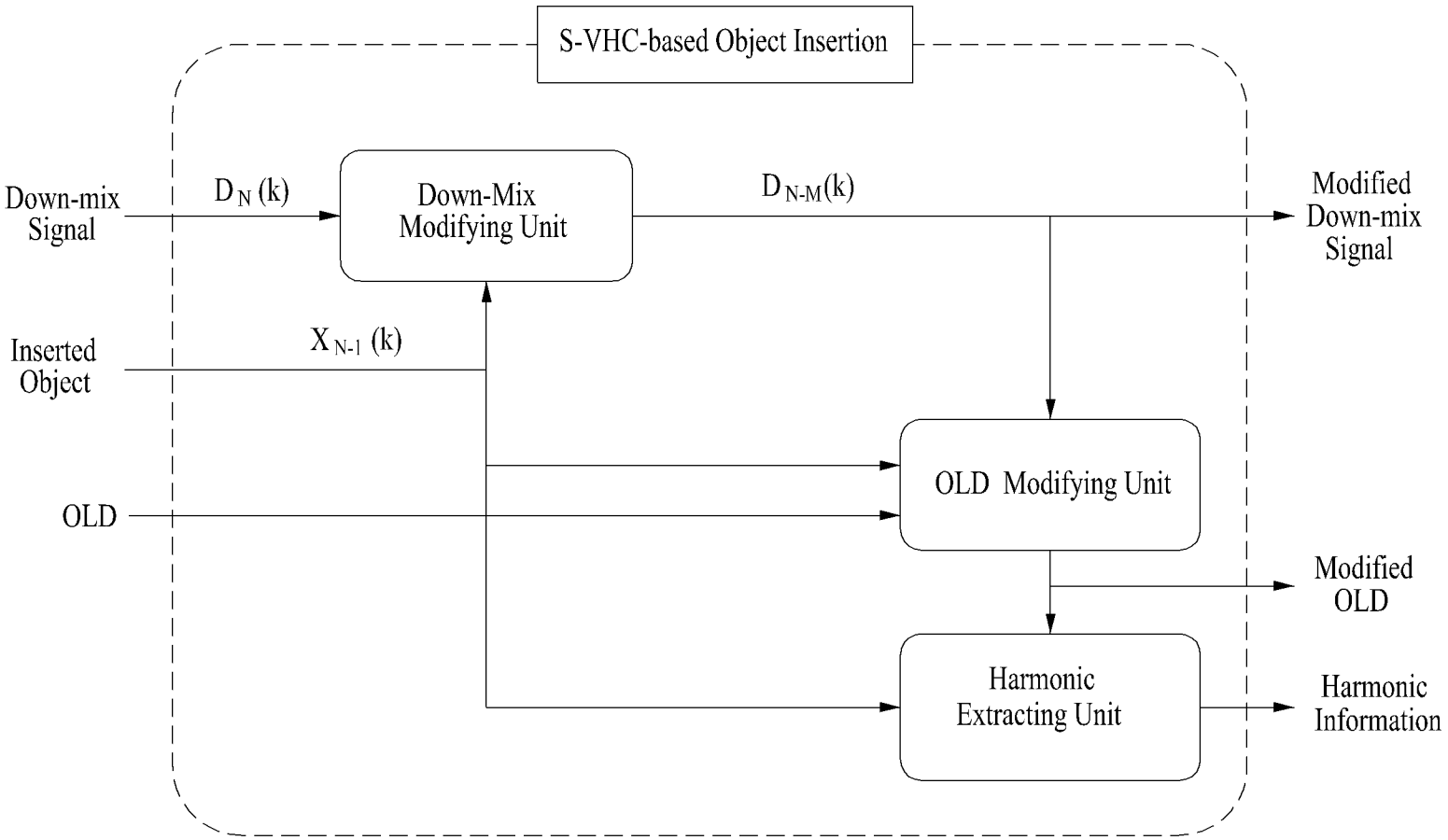
FIG. 24 is a block diagram illustrating a VHC-based object insertion module according to an embodiment of the inventive concept.

FIG. 24 is a block diagram illustrating a VHC-based object insertion module according to an embodiment of the inventive concept.

Referring to FIG. 24, a down-mix modifying unit may generate a modified down-mix signal $D_{N-m}(k)$ by modifying a down-mix signal $D_N(k)$ based on an inserted object signal $X_{N+1}(k)$.

Also, an OLD modifying unit may modify an OLD based on contents described with reference to FIG. 22.

Also, a harmonic extracting unit may extract a harmonic from the modified down-mix signal. A description for VHC with reference to FIGS. 1 to 12 may be applied without change.

The methods according to the above-described exemplary embodiments of the inventive concept may be recorded in computer-readable media including program instructions to implement various operations embodied by a computer. The media may also include, alone or in combination with the program instructions, data files, data structures, and the like. The program instructions recorded in the media may be designed and configured specially for the exemplary embodiments of the inventive concept or be known and available to those skilled in computer software. Computer-readable media include magnetic media such as hard disks, floppy disks, and magnetic tape; optical media such as CD ROM disks and DVDs; magneto-optical media such as floptical disks; and hardware devices that are specially configured to store and perform program instructions, such as read-only memory (ROM), random access memory (RAM), flash memory, and the like. Program instructions include both machine code, such as produced by a compiler, and files containing higher level code that may be executed by the computer using an interpreter. The described hardware devices may be configured to act as one or more software modules to perform the operations of the above-described exemplary embodiments of the inventive concept, or vice versa.

MODE FOR INVENTION

While a few exemplary embodiments have been shown and described with reference to the accompanying drawings, it will be apparent to those skilled in the art that various modifications and variations can be made from the foregoing descriptions. For example, adequate effects may be achieved even if the foregoing processes and methods are carried out in different order than described above, and/or the aforementioned elements, such as systems, structures, devices, or circuits, are combined or coupled in different forms and modes than as described above or be substituted or switched with other components or equivalents.

Therefore, other implements, other embodiments, and equivalents to claims are within the scope of the following claims.

The invention claimed is:

1. A personal audio studio system, the system comprising:

a selector configured to select one of non-compressed input content and compressed input content including a plurality of object signals;

a first object control module configured to compress the non-compressed input content; and a second object control module configured to remove an object signal from the compressed input content, to edit the object signal for the compressed input content, or to insert the object signal into the compressed input content, wherein the second object control module removes an object using one of object removal based on an SAOC method, object removal based on a VHC method, and object removal based on an RC method, and wherein the second object control module generates a weighted factor based on a removed object signal, modifies a down-mix signal based on the weighted factor, and modifies an OLD for each of a plurality of object signals to perform the object removal based on the SAOC method.

2. The system of claim 1, wherein the first object control module selectively uses one of a spatial audio object coding (SAOC) method, a vocal harmonic coding (VHC) method, and a residual coding (RC) method.

3. The system of claim 2, wherein the first object control module uses the RC method for outputting a down-mix signal, an object level difference (OLD), and a residual signal for each object signal.

4. The system of claim 1, wherein the second object control module inserts an object using one of object insertion based on an SAOC method, object insertion based on a VHC method, and object insertion based on an RC method.

5. The system of claim 4, wherein the second object control module modifies a down-mix signal based on an inserted object signal and modifies an OLD for each of a plurality of object signals to perform the object insertion based on the SAOC method.

6. The system of claim 4, wherein the second object control module modifies a down-mix signal based on an inserted object signal, modifies an OLD for each of a plurality of object signals, and generates harmonic information to perform the object insertion based on the VHC method.

7. The system of claim 4, wherein the second object control module generates a weighted factor based on a removed object signal, modifies a down-mix signal based on the weighted factor, modifies an OLD for each of a plurality of object signals, and modifies a residual signal for each of the plurality of object signals based on the modified OLD to perform the object insertion based on the RC method.

8. A control module for a personal audio studio system, the control module comprising:

an object removal module; and an object insertion module, wherein the object removal module removes an object using one of object removal based on an SAOC method, object removal based on a VHC method, and object removal based on an RC method, and wherein the object insertion module inserts an object using one of object insertion based on the SAOC method, object insertion based on the VHC method, and object insertion based on the RC method, and wherein the object removal module generates a weighted factor based on a removed object signal, modifies a down-mix signal based on the weighted factor, modifies an OLD for each of a plurality of object signals, and modifies a residual signal for each of the plurality of object signals based on the modified OLD to perform the object insertion based on the RC method.

9. The control system of claim 8, wherein the object removal module modifies a down-mix signal based on an inserted object signal and modifies an OLD for each of a plurality of object signals to perform the object insertion based on the SAOC method.

10. The control system of claim 8, wherein the object removal module modifies a down-mix signal based on an inserted object signal, modifies an OLD for each of a plurality of object signals, and generates harmonic information to perform the object insertion based on the VHC method.

11. The control system of claim 8, wherein the object insertion module modifies a down-mix signal based on an inserted object signal and modifies an OLD for each of a plurality of object signals to perform the object insertion based on the SAOC method.

12. The control system of claim 8, wherein the object insertion module modifies a down-mix signal based on an inserted object signal, modifies an OLD for each of a plurality of object signals, and generates harmonic information to perform the object insertion based on the VHC method.

13. The control system of claim 8, wherein the object insertion module generates a weighted factor based on a removed object signal, modifies a down-mix signal based on the weighted factor, modifies an OLD for each of a plurality of object signals, and modifies a residual signal for each of the plurality of object signals based on the modified OLD to perform the object insertion based on the RC method.

14. A personal audio studio system, the system comprising:

a selector configured to select one of non-compressed input content and compressed input content including a plurality of object signals;

a first object control module configured to compress the non-compressed input content; and a second object control module configured to remove an object signal from the compressed input content, to edit the object signal for the compressed input content, or to insert the object signal into the compressed input content, wherein the second object control module removes an object using one of object removal based on an SAOC method, object removal based on a VHC method, and object removal based on an RC method, and wherein the second object control module generates a weighted factor based on a removed object signal, modifies a down-mix signal using the weighted factor and a filter for harmonic removal, and modifies an OLD for each of a plurality of object signals to perform the object removal based on the VHC method.

15. A personal audio studio system, the system comprising:

a selector configured to select one of non-compressed input content and compressed input content including a plurality of object signals;

a first object control module configured to compress the non-compressed input content; and a second object control module configured to remove an object signal from the compressed input content, to edit the object signal for the compressed input content, or to insert the object signal into the compressed input content, wherein the second object control module removes an object using one of object removal based on an SAOC method, object removal based on a VHC method, and object removal based on an RC method, and wherein the second object control module generates a weighted factor based on a removed object signal, modifies a down-mix signal based on the weighted factor, modifies an OLD for each of a plurality of object signals, and modifies a residual signal for each of the plurality of object signals based on the modified OLD to perform the object removal based on the RC method.

* * * * *